US007874758B2

(12) United States Patent
Tanaka et al.

(10) Patent No.: US 7,874,758 B2
(45) Date of Patent: Jan. 25, 2011

(54) BINDING DEVICE

(75) Inventors: Kanji Tanaka, Ashiya (JP); Hiroshi Arai, Kawachinagano (JP); Hiroyuki Yamashita, Takarazuka (JP)

(73) Assignee: Lihit Lab., Inc., Osaka (JP)

( * ) Notice: Subject to any disclaimer, the term of this patent is extended or adjusted under 35 U.S.C. 154(b) by 571 days.

(21) Appl. No.: 11/577,692

(22) PCT Filed: Jan. 11, 2005

(86) PCT No.: PCT/JP2005/000197

§ 371 (c)(1),
(2), (4) Date: Apr. 20, 2007

(87) PCT Pub. No.: WO2006/043341

PCT Pub. Date: Apr. 27, 2006

(65) Prior Publication Data

US 2009/0067914 A1 Mar. 12, 2009

(30) Foreign Application Priority Data

Oct. 22, 2004 (JP) ..... 2004-308488

(51) Int. Cl.
*B42F 9/00* (2006.01)

(52) U.S. Cl. ..... 402/69; 24/67.7; 24/67.11; 402/19; 281/21.1

(58) Field of Classification Search ..... 24/67 R, 24/67.3, 67.5, 67.7, 67.9, 67.11, 502, 503; 281/21.1, 44, 45; 402/19, 23, 22, 27–29, 402/67, 64, 66, 68, 69, 80 R, 35, 36, 42, 57; 312/185; *B42F 9/00, 1/00, 1/02, 1/04, 1/08*
See application file for complete search history.

(56) References Cited

U.S. PATENT DOCUMENTS 802,569 A * 10/1905 Johnson ..... 24/67.7

(Continued)

FOREIGN PATENT DOCUMENTS

JP 49-24310 U 3/1974

(Continued)

OTHER PUBLICATIONS

Official communication issued in the counterpart International Application No. PCT/JP2005/000197, mailed on Mar. 8, 2005.

(Continued)

*Primary Examiner*—Dana Ross
*Assistant Examiner*—Pradeep C Battula
(74) *Attorney, Agent, or Firm*—Keating & Bennett, LLP

(57) ABSTRACT

A binding device having a binding member that operates at a binding position of objects to be bound has a structure with which the bound objects do not readily come off. The binding device includes a board having a bearing plate. A spring member and an operation lever are attached to a shaft inserted in the bearing plate and a turned-up part. Protruding pieces of a binding member are inserted in through holes of turned-up parts formed in the board. One end of the spring member is secured to the operation lever, and the other end is fitted in a through hole of a turned portion at the distal end of the binding member. By closing the operation lever, the binding member rotates around a line connecting the protruding pieces at both ends, thereby pressing down sheets of paper placed on the board with a pressing portion. At this time, the other end of the spring member presses the turned portion, thereby biasing the pressing portion.

7 Claims, 26 Drawing Sheets

U.S. PATENT DOCUMENTS

| | | | | | |
|---|---|---|---|---|---|
| 4,989,298 | A | * | 2/1991 | Wang | 24/67 R |
| 5,472,238 | A | * | 12/1995 | Sato | 281/45 |

FOREIGN PATENT DOCUMENTS

| | | | | |
|---|---|---|---|---|
| JP | 49-76714 | U | | 7/1974 |
| JP | 51-1856 | U | | 1/1976 |
| JP | 51-105514 | U | | 8/1976 |
| JP | 61-180765 | U | | 11/1986 |
| JP | 61-180767 | U | | 11/1986 |
| JP | 06-74374 | U | | 10/1994 |
| JP | 07246794 | A | * | 9/1995 |
| JP | 07-246794 | A | | 4/2007 |

OTHER PUBLICATIONS

Official communication issued in the counterpart International Application No. PCT/JP2005/000197, mailed on Oct. 10, 2006.

Translation of the Official Communication issued in counterpart International Application No. PCT/JP2005/000197, mailed on Aug. 2, 2007.

* cited by examiner (A)

(B)

BINDING DEVICE

BACKGROUND OF THE INVENTION

1. Field of the Invention

The present invention relates to a binding device, and particular to a binding device for holding together sheets of paper or other objects and binding them into a file.

2. Description of the Related Art

FIG. 33 shows one example of a conventional binding device.

The binding device 1 includes a board 2 and a bearing plate 3 provided upright at one widthwise side of the board 2.

An operation lever 4 is pivotally attached to the bearing plate 3 so that it is rotatable in a plane that is substantially perpendicular to the board 2.

Furthermore, a pressing plate 5 is provided, which is movable towards and away from the board 2 in response to the rotation of the operation lever 4.

A spring member 6 is provided between the pressing plate 5 and the operation lever 4 for biasing the pressing plate 5 toward the board 2 when the operation lever 4 is operated. Cranks 7 are attached on both sides of this spring member 6. The cranks 7 are bridged between the bearing plate 3 and the pressing plate 5 so that the pressing plate 5 is substantially parallel to the board 2 when it is close to and separated from the board 2.

The pressing plate 5 has an inverted U-shape cross section to hold down the objects to be bound, such as paper, with both of its widthwise ends.

With this binding device 1, by operating the operation lever 4, the pressing plate 5 is displaced toward the board 2 as it moves along the bearing plate 3 so that the objects to be bound, such as paper, are held and secured therebetween.

However, one problem with this binding device 1 is that, since the pressing plate 5 moves along the bearing plate 3, it moves along one end of the objects to be bound, such as paper, which makes it difficult to set the objects to be bound, such as paper, in a binding position.

To solve this problem, another binding device shown in FIG. 34 was devised.

This binding device 8 does not include any cranks, and the pressing plate 5 is rotatably attached to a rotation axis 9*a* that is connected to two arms 9.

The ends of the arms 9 are rotatably attached to the bearing plate 3, and the pressing plate 5 is attached so as to be rotatable around two axes, i.e., at the attachment part on the bearing plate 3 and around the rotation axis 9*a*.

With this binding device 8, by operating the operation lever 4, the pressing plate 5 rotates around the attachment parts of the arms 9 on the bearing plate 3 and around the rotation axis 9*a* as it is pressed toward the board 2, the pressing plate 5 being remained substantially in parallel with the bearing plate 3. Therefore, as the pressing plate 5 moves at the binding position of the objects to be bound, such as paper, the objects can be easily set at the binding position (see Japanese Patent Laid-Open Publication No. Hei 7-246794 (Patent Document 1)).

FIG. 35 shows another binding device 12 that has a plate-like holding plate 10 rotatably supported at pivotal support parts 11 on the board 2, so that objects to be bound, such as paper, are bound on one side of the pivotal support parts 11.

With this binding device 12, a spring member 6 is provided to bias the other side of the pivotal support parts 11 of the holding plate 10 so as to hold together the objects to be bound, such as paper, at one side of the pivotal support parts 11 of the holding plate 10 (see Japanese Utility Model Laid-Open Publication No. Sho 49-76714 (Patent Document 2)).

However, with the binding devices shown in FIG. 33 and FIG. 34, the objects to be bound, such as paper, are pressed with both widthwise ends of the pressing plate that has an inverted U-shape cross section, which means that the force exerted by the spring member is dispersed, causing the bound objects, such as paper, to readily come off.

The problem with the binding device shown in FIG. 35 is that since it has a structure in which the bound objects, such as paper, are held on one side of the pivotal support parts of the holding plate while the other side of the pivotal support parts is biased with the spring member, considering the size of the entire binding device that is attached to a file, the length from the pivotal support parts to the binding side is longer than that to the spring member side. Accordingly, the force applied at the binding side of the holding plate is less than the biasing force applied by the spring member, which makes it likely that the bound objects, such as paper, will readily come off.

SUMMARY OF THE INVENTION

To overcome the problems described above, preferred embodiments of the present invention provide a binding device having a binding member that works at a binding position of objects to be bound, such as paper, the binding device having a structure with which the bound objects are prevented from coming off.

A preferred embodiment of the present invention provides a binding device including a plate-like board, an operation lever rotatably supported on the board, at least a one-piece binding member having a pressing portion at a distal end thereof arranged to press down and hold objects to be bound on the board, and a spring member coupled to the operation lever and to the distal end of the binding member so as to apply pressure to the distal end of the binding member when the operation lever is operated, the binding member being rotatable around an axis at an opposite side from the pressing portion when the operation lever is operated and being formed by bending the distal end of the pressing portion towards the rotation center of the binding member.

The binding member of this binding device may be made of a single plate material, the distal end of the plate material defining the pressing portion such that the objects to be bound are pressed down along a straight line or at a plurality of positions along a straight line.

The pressing portion may be formed by bending the distal end of the binding member made of the plate material towards the rotation center of the binding member.

Alternatively, the pressing portion may be formed by bending the distal end of the binding member made of the plate material towards the rotation center of the binding member and by bending the distal end again toward the board side.

The rotation center of the binding member may be defined by providing protruding pieces projecting from both ends of the binding member and inserting these protruding pieces into through holes provided in turned-up parts provided in the board.

Further, rotation axes of the operation lever and the binding member may either be substantially perpendicular or substantially parallel to each other.

Since the pressing portion is provided at the distal end of the binding member and the binding member is rotatable around the axis at the opposite side from the pressing portion, the pressing portion of the binding member is deformed at the binding position of the bound objects, such as paper.

Moreover, because pressure is applied by the spring member directly to the distal end of the binding member, the force from the spring member is directly applied to the bound objects, whereby the bound objects, such as paper, will not easily come off of the binding device.

With the binding member being made of a single plate material, and with the pressing portion being arranged so as to press down the bound objects along a straight line or at a plurality of positions along a straight line, the force from the spring member is not substantially dispersed, which further ensures that the objects will not easily come off.

With the distal end of the plate-like binding member being bent towards its rotation center, when the bound objects are pulled in a direction out of the binding device, the pressing portion will resist this pulling-out direction applied to the objects, whereby the objects will not easily come off.

With the rotation center of the binding member being provided by inserting the protruding pieces projecting from the ends of the binding member into the through holes in the turned-up parts of the board, the number of components is reduced as compared to the design in which a rotation shaft is used around which the binding member is rotated, whereby the binding device can be produced at low cost.

Further, the rotation axes of the operation lever and the binding member can be freely arranged.

Preferred embodiments of the present invention thus provide a binding device having a binding member that operates at a binding position of objects to be bound, such as paper, the binding device having a structure which prevents the bound objects from coming off.

The above and other elements, characteristics, features and advantages of the present invention will become more readily apparent from the following description of preferred embodiments in conjunction with the accompanying drawings.

DETAILED DESCRIPTION OF PREFERRED EMBODIMENTS

Figure 1:
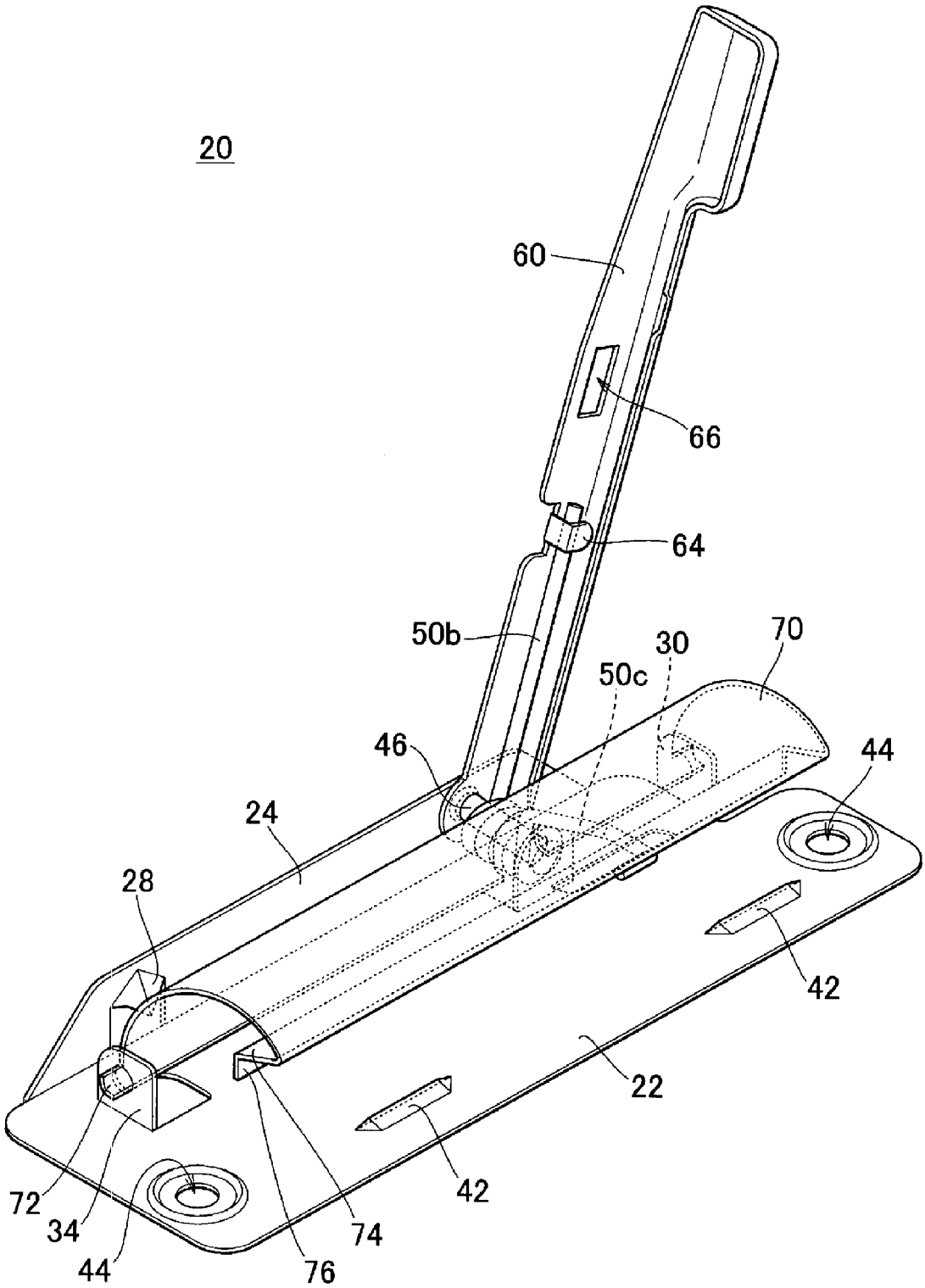
FIG. 1 is a perspective view illustrating a preferred embodiment of the binding device of this invention.
Figure 2:
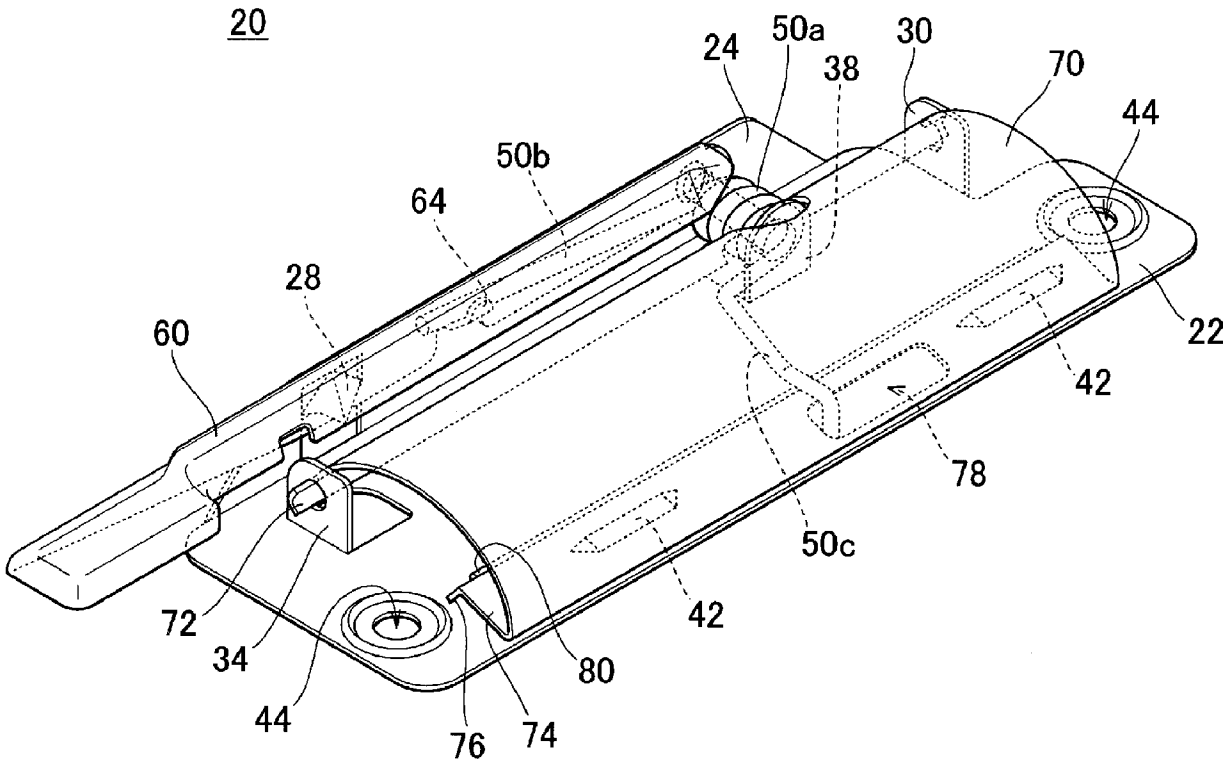
FIG. 2 is a perspective view of the binding device of FIG. 1 in a closed state.

FIG. 1 is a perspective view illustrating one preferred embodiment of the binding device according to the present invention, and FIG. 2 is a perspective view of this binding device in a closed state.

Figure 3:
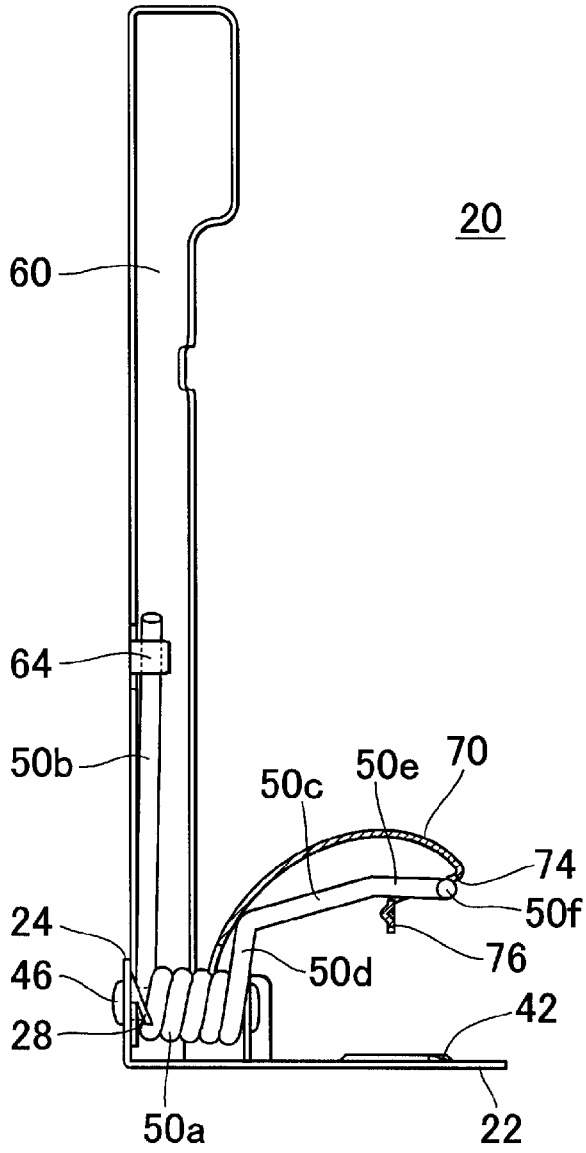
FIG. 3 is a side diagram of the binding device of FIG. 1 in an open state.
Figure 4:
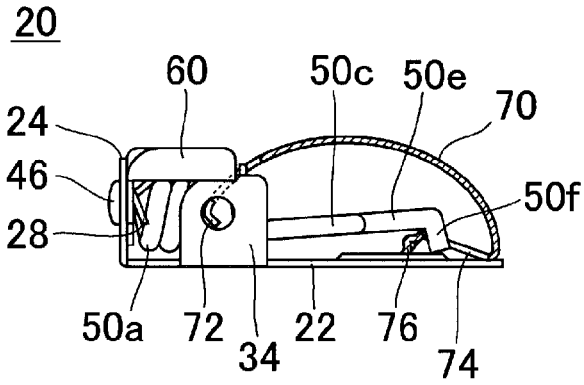
FIG. 4 is a side diagram of the binding device of FIG. 1 in a closed state.

FIG. 3 is aside diagram of the binding device in an open state, and FIG. 4 is a side diagram of the binding device in a closed state.

Figure 5:
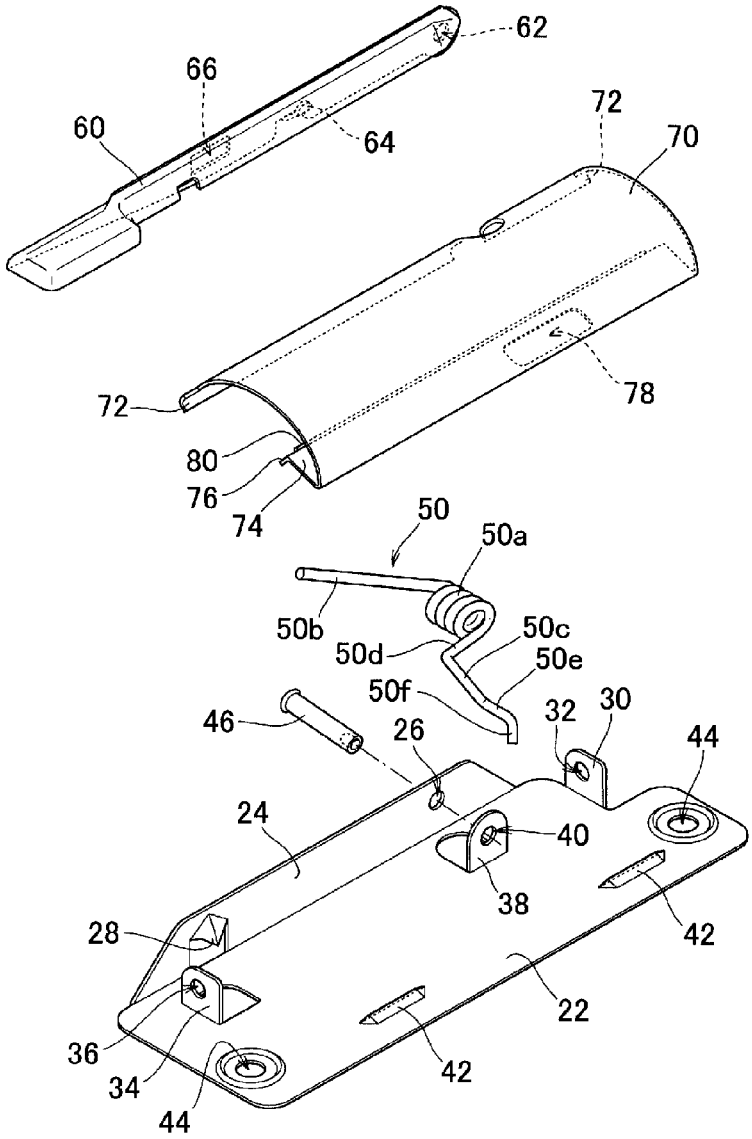
FIG. 5 is an exploded perspective view of the binding device of FIG. 1.

The binding device 20 includes a board 22 made of a thin metal plate. Along the straight lengthwise edge at one widthwise end of the board 22 a bearing plate 24 that is upright relative to the board 22 is integrally provided, as shown in FIG. 5. The bearing plate 24 is continuous from the front end edge to the vicinity of the rear end edge along the length of the board 22. At one lengthwise end (rear end) of the bearing plate 24, a substantially circular through hole 26 is provided, and at the other lengthwise end (front end) of the bearing plate 24, a retainer projection 28 is provided to retain an operation lever that will be described later.

The retainer projection 28 is formed by, for example, providing a quadrangle aperture in the bearing plate 24 and pressing out an upper part of the aperture towards the board 22.

Near the rear end of the bearing plate 24 in which the through hole 26 is provided, at a suitable distance from the bearing plate 24, one corner at one lengthwise end of the board 22 is cut and turned up to define a turned-up part 30. The main surface of the turned-up part 30 is substantially perpendicular to the main surface of the bearing plate 24. This turned-up part 30 includes a substantially circular through hole 32.

Furthermore, another turned-up part 34 having a surface that is substantially parallel to the main surface of the turned-up part 30 is provided near the front end at which the retainer projection 28 is provided. The turned-up part 34 is provided by forming a U-shape cut in the board 22 and turning up this part. This turned-up part 34 includes a substantially circular through hole 36. These turned-up parts 30 and 34 are opposite to each other such that a line connecting their through holes 32 and 36 is substantially parallel to the main surface of the bearing plate 24 on the side of the board 22.

Between these turned-up parts 30 and 34 and on the side away from the bearing plate 24 relative to the line connecting the through holes 32 and 36 of the turned-up parts 30 and 34, a turned-up part 38 having a surface that is substantially parallel to the surface of the bearing plate 24 is provided. This turned-up part 38 is also provided by forming a substantially U-shape cut in the board 22 and turning up this part. This turned-up part 38 includes a substantially circular through hole 40 and is positioned such that its through hole 40 is opposite the through hole 26 of the bearing plate 24. That is, turned-up part 38 is arranged so that the line connecting the through holes 32 and 36 of the turned-up parts 30 and 34 is substantially perpendicular to the line connecting the through holes 26 and 40 of the bearing plate 24 and the turned-up part 38.

At the other widthwise end of the board 22, two projections 42 are provided. These projections 42 are arranged side by side and spaced from each other in the lengthwise direction of the board 22.

Furthermore, a pair of through holes 44 is provided at both lengthwise ends of the board 22, one at the front end and one at the rear end, for attaching the binding device 20 to a file or other suitable article.

A shaft 46 is inserted in the through hole 26 of the bearing plate 24 and in the through hole 40 of the turned-up part 38, and a spring member 50 including a torsion coil spring and the operation lever 60 are attached to the shaft 46. The spring member 50 includes a coil part 50*a*, one end 50*b* of the coil part 50*a* extending substantially parallel to the surface of the bearing plate 24, and the other end 50*c* of the coil part 50*a* extending in the widthwise direction of the board 22 toward a direction away from the bearing plate 24.

The operation lever 60 is made of a metal plate or other suitable material and has an elongated shape with a substantially L-shaped or U-shaped cross section to increase its strength. A substantially circular through hole 62 is provided in the vertical side wall at one lengthwise end of the operation lever 60. The shaft 46 is attached to the bearing plate 24 and to the turned-up part 38 such that it is inserted in the through hole 62 of the operation lever 60 and in the coil part 50*a* of the spring member 50. One end 50*b* of the spring member 50 is arranged to run along the inside of the operation lever 60 and secured with a bent portion 64 that is formed by inwardly bending part of the vertical side wall of the operation lever 60.

Furthermore, a substantially rectangular through hole 66 is provided in the vertical wall of the operation lever 60 at the position corresponding to the retainer projection 28 of the bearing plate 24. The retainer projection 28 is fitted in this through hole 66 to secure the operation lever 60 to the bearing plate 24.

Furthermore, the other lengthwise end of the operation lever 60 includes a wide portion to allow easy operation with a finger.

Furthermore, a binding member 70 that is substantially rectangular in top view is attached on the board 22 so as to extend along the length of the board 22 and substantially parallel to the bearing plate 24. The binding member 70 is made of, for example, a single metal plate. The binding member 70 has a length that is substantially equal to the distance between, for example, the turned-up parts 30 and 34, and is configured to have a widthwise curved, upwardly bulging shape (semi-circular cross section).

On the bearing plate 24 side of the width of the binding member 70, protruding pieces 72 or pivotal axes are provided so as to protrude from the lengthwise ends. These protruding pieces 72 are fitted in the through holes 32 and 36 of the turned-up parts 30 and 34, which define bearings. Therefore, the binding member 70 is rotatable around the line connecting the two protruding pieces 72.

To increase the strength of the protruding pieces 72 and to facilitate rotation of the protruding pieces 72 inside the through holes 32 and 36, the protruding pieces 72 are warped in the widthwise direction. Thus, the protruding pieces 72 protruding from the binding member 70 are fitted in the through holes 32 and 36 of the turned-up parts 30 and 34, whereby the number of components is reduced as compared to a design in which a separate part, such as a rotation shaft, is used to rotatably hold the binding member 70.

The opposite side from the bearing plate 24 of the width of the binding member 70 is turned toward the above-described rotation center (protruding pieces 72 side) to define a turned portion 74. The turned portion 74 is continuous from the front end edge to the rear end edge of the binding member 70.

Furthermore, the distal end of the turned portion 74 is turned toward the board 22 to define a pressing portion 76 arranged to press objects to be bound 100, such as paper. The pressing portion 76 is continuous from the front end edge to the rear end edge of the turned portion 74. The pressing portion 76 is arranged to incline toward the rotation center of the binding member 70 from the turned portion 74 to the board 22 when the binding member 70 is closed on the board 22.

Therefore, the turned portion 74 and the pressing portion 76 are continuous in a substantially L-shaped manner. This pressing portion 76 presses the bound objects 100, such as paper, along one straight line. Note, when the binding member 70 is closed on the board 22, the turned portion 74 is inclined upward from one end of the binding member 70 to the inside of the binding member 70.

One end 50*b* of the spring member 50 extends linearly from the rear upper end on the bearing plate 24 side of the coil part

50*a* to the front, and is arranged such that, when no force is applied to its distal end, the distal end extends diagonally upwards toward the front. The other end 50*c* is substantially L-shaped, extending from the front lower end on the side of the turned-up part 38 of the coil part 50*a* toward the opposite side from the bearing plate 24, and when no force is applied, its upright portion 50*d* extends upwards and a bridge portion 50*e* extends diagonally upwards from the upper end of the upright portion 50*d*, and a projecting engaging portion 50*f* is turned horizontally from the free end of the bridge portion 50*e*.

The turned portion 74 includes a substantially rectangular through hole 78, and the other end 50*c* of the spring member 50 is fitted therein from above, the distal end of the other end 50*c* of the spring member 50 being bent so that it does not separate from the through hole 78. In this preferred embodiment, the through hole 78 is provided at a position closer to the coil part 50*a* coiled around the shaft 46, between the protruding pieces 72 at the front and rear ends of the binding member 70.

Furthermore, the pressing portion 76 includes a linear rib 80 to prevent deformation caused by the force applied to press down the objects to be bound 100, such as paper.

The distal end of the spring member 50 (engaging portion 50*f*) remains substantially in the same position in the widthwise direction of the board 22 whether the binding member 70 is closed or opened as shown in FIG. 3 and FIG. 4.

When the operation lever 60 is locked in the retainer projection 28, with the binding member 70 pressing down the objects to be bound 100, such as paper, the other end 50*c* of the spring member 50, which is initially bent, is stretched, and the distal end (engaging portion 50*f*) is twisted so that the engaging portion 50*f* is deformed downwards from its initial horizontal position. The through hole 78 extends along the length and the width of the turned portion 74 so as to allow for this deformation of the spring member 50.

Figure 6:
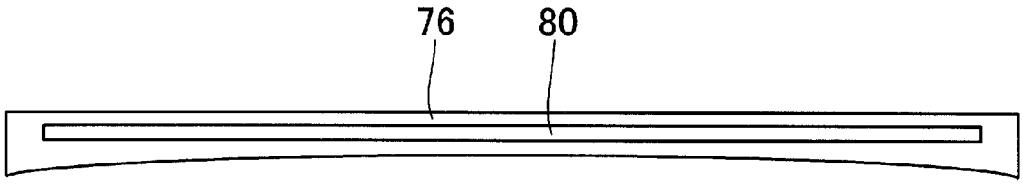
FIG. 6 is a plan view illustrating a variation of the pressing portion of the binding device of FIG. 1.
Figure 7:
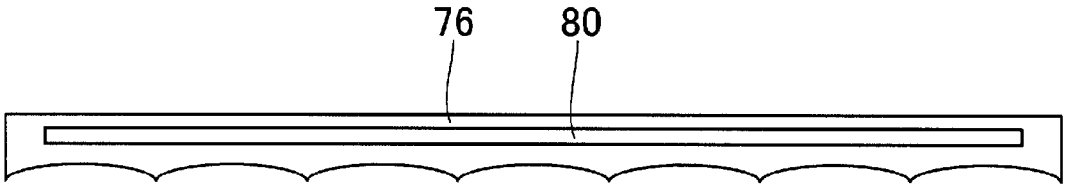
FIG. 7 is a plan view illustrating another variation of the pressing portion of the binding device of FIG. 1.

The portion pressed down by the pressing portion 76 needs not be one straight line, but instead, as shown in FIG. 6, it may be pressed with both lengthwise ends of the pressing portion 76. In this case, the edge of the pressing portion 76 is slightly warped inwards from the lengthwise ends to the center. Also, as shown in FIG. 7, a plurality of dents may be provided along the length of the pressing portion 76 so as to press down the objects to be bound 100, such as paper, at a plurality of points along a straight line.

Figure 8:
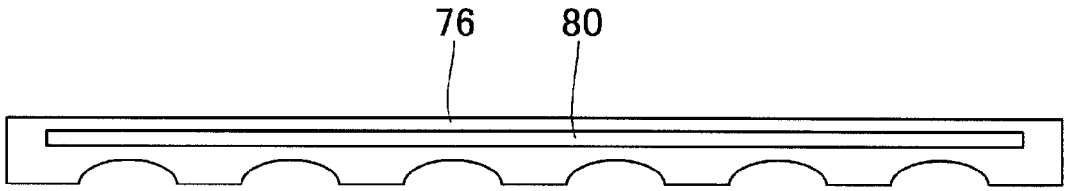
FIG. 8 is a plan view illustrating yet another variation of the pressing portion of the binding device of FIG. 1.

Furthermore, the objects to be bound 100, such as paper, can be pressed at a plurality of positions along a straight line as shown in FIG. 8, in this case not at points but linearly. In other words, the portion pressed with the pressing portion 76 may either be a single straight line, or a plurality of points or lines along a straight line.

Figure 9:
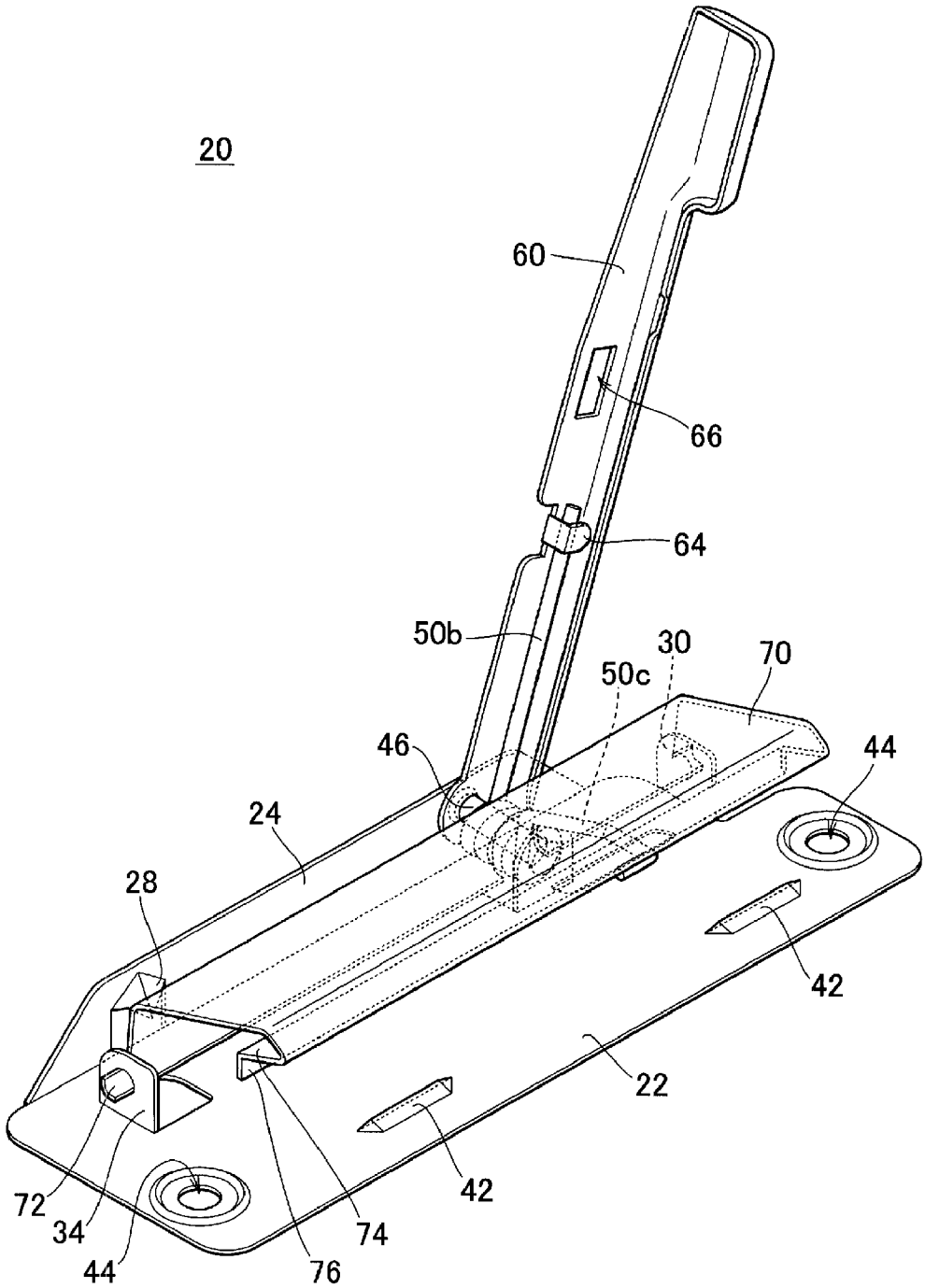
FIG. 9 is a perspective view illustrating another preferred embodiment of the binding device of the present invention.
Figure 10:
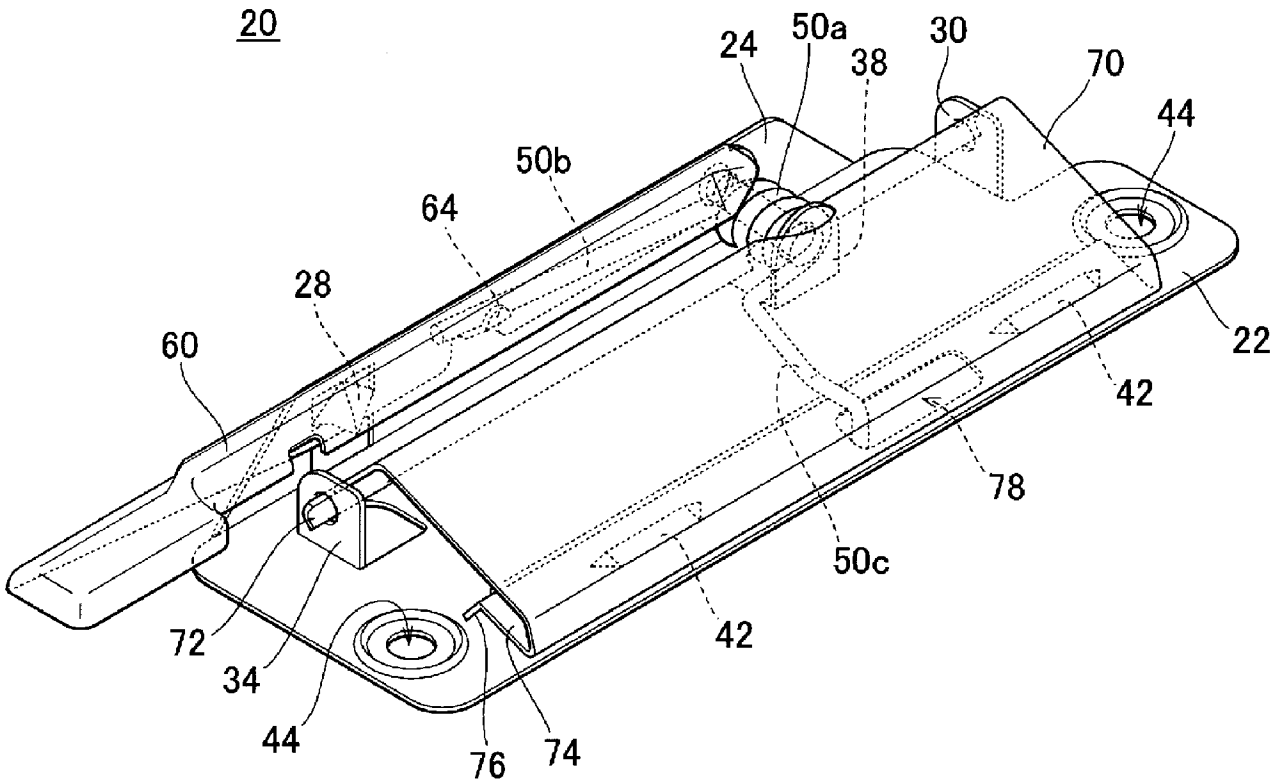
FIG. 10 is a perspective view of the binding device of FIG. 9 in a closed state.
Figure 11:
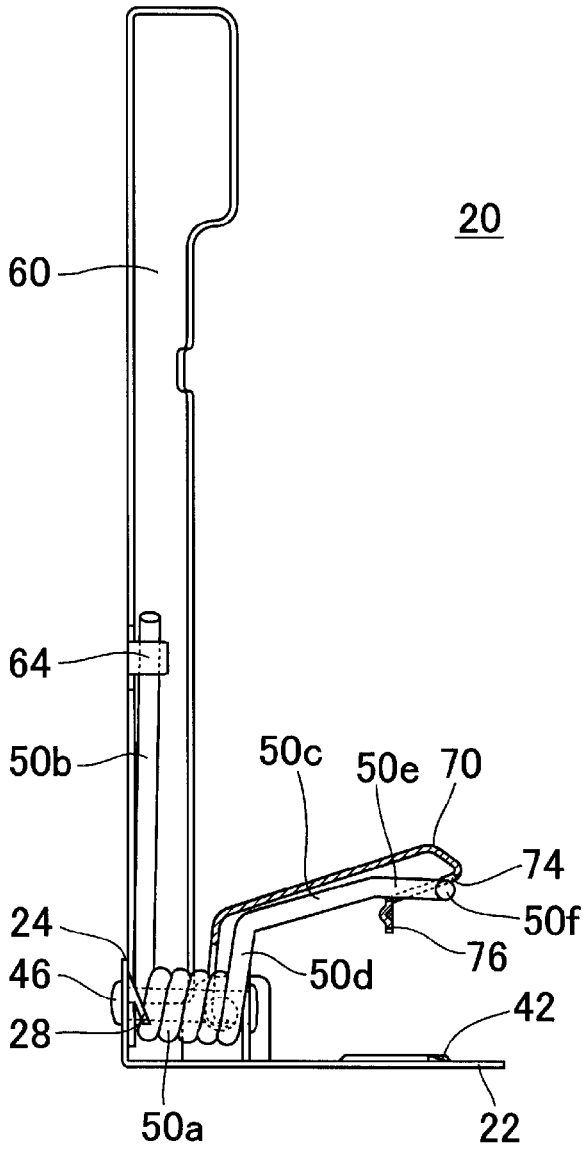
FIG. 11 is a side diagram of the binding device of FIG. 9 in an open state.
Figure 12:
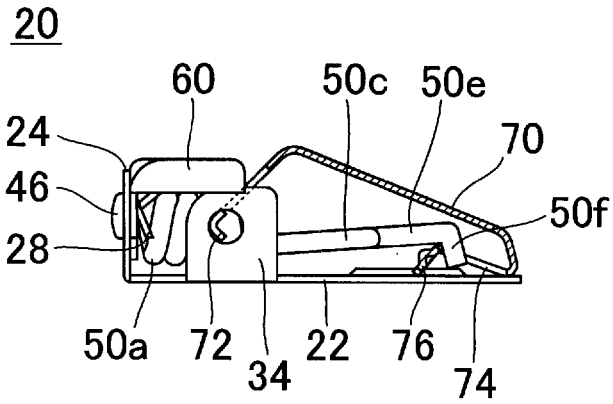
FIG. 12 is a side diagram of the binding device of FIG. 9 in a binding state.

The binding member 70 may be formed by bending a metal plate as shown in FIG. 9 or FIG. 12 instead of the warped shape.

This binding device 20 is attached to a file or other articles using, for example, metal fixture parts inserted in the through holes 44 in the board 22.

The binding member 70 is opened and closed by operating the operation lever 60. Referring now to FIG. 1, when the operation lever 60 is turned up, the other end 50*c* of the spring member 50 lifts up the binding member 70, creating a gap between the board 22 and the pressing portion 76 of the binding member 70. Objects to be bound 100, such as paper, are inserted in this gap, and the operation lever 60 is turned down to close the binding member 70 so that the objects to be bound 100, such as paper, are pressed down onto the board 22 with the pressing portion 76. That is, turning down the operation lever 60 tightens up the coil part 50*a* of the spring member 50, whereby the other end 50*c* of the spring member 50 biases the pressing portion 76 toward the board 22.

Figure 13:
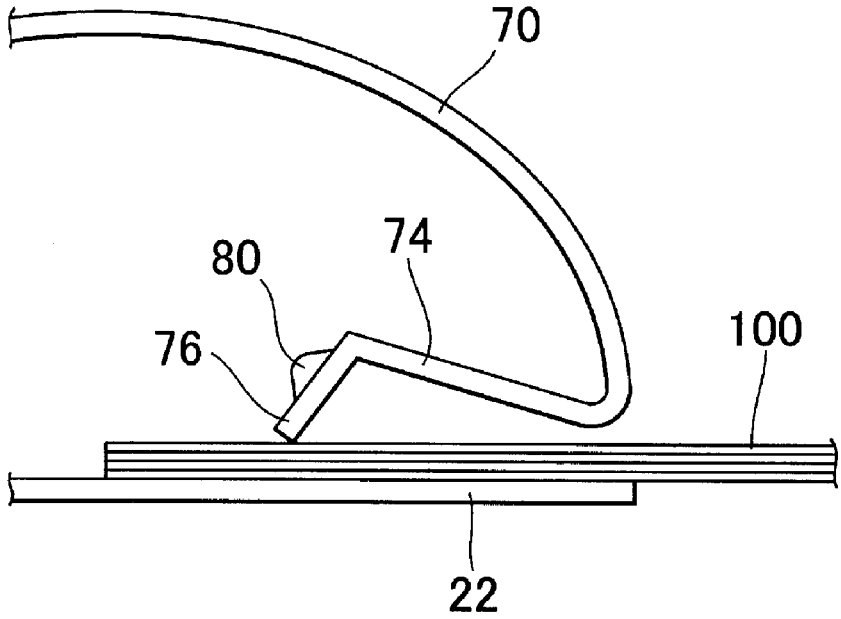
FIG. 13 is a diagram illustrating the state of the pressing portion when a small amount of paper is bound with the binding device of FIG. 1.

Here, as shown in FIG. 13, the pressing portion 76 is pressed diagonally against the bound objects 100, such as paper. When a force is applied that causes the bound objects 100, such as paper, to be pulled out, there will be a force applied oppositely from the inclined direction of the pressing portion 76 as well as a force that causes the bent portion of the turned portion 74 and the pressing portion 76 to bend further. The restoring force caused by the deformation of the turned portion 74 and the pressing portion 76 creates a resisting force against the pulling-out of the bound objects 100, such as paper, from the pressing portion 76, whereby the bound objects 100, such as paper, do not easily come off of the binding device 20.

Figure 14:
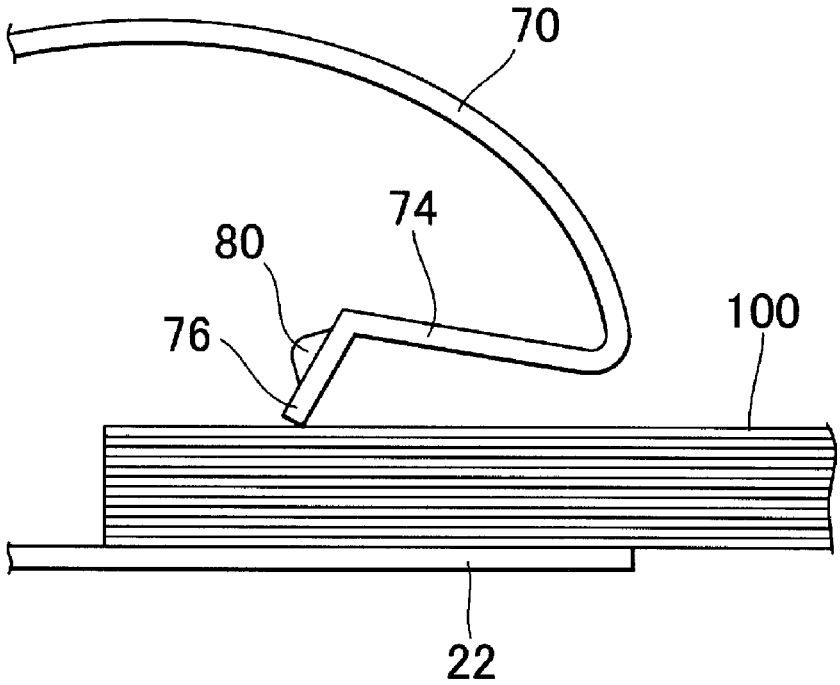
FIG. 14 is a diagram illustrating the state of the pressing portion when a large amount of paper is bound with the binding device of FIG. 1.

Moreover, because the pressing portion 76 is inclined toward the rotation center of the binding member 70 from the turned portion 74 to the board 22, as shown in FIG. 14, when the objects to be bound 100, such as paper, are thick, the pressing portion 76, while it is more upright than when the objects 100 are thin, is unlikely to be positioned perpendicular to the surface of the bound objects 100, such as paper, so that the resisting force against the coming-off of the bound objects 100, such as paper, is well retained.

Figure 15:
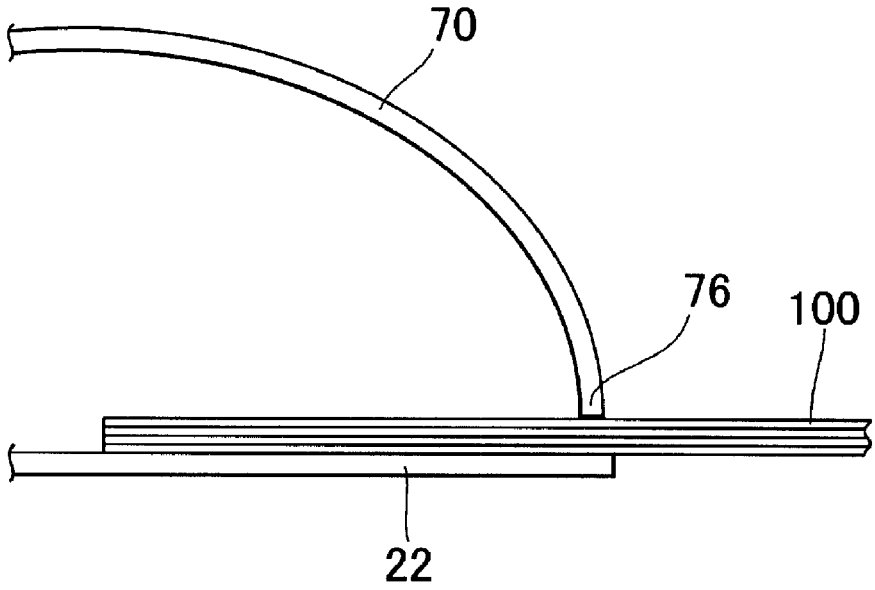
FIG. 15 is a diagram illustrating the state wherein a small amount of paper is bound with a binding device having a different pressing portion.
Figure 16:
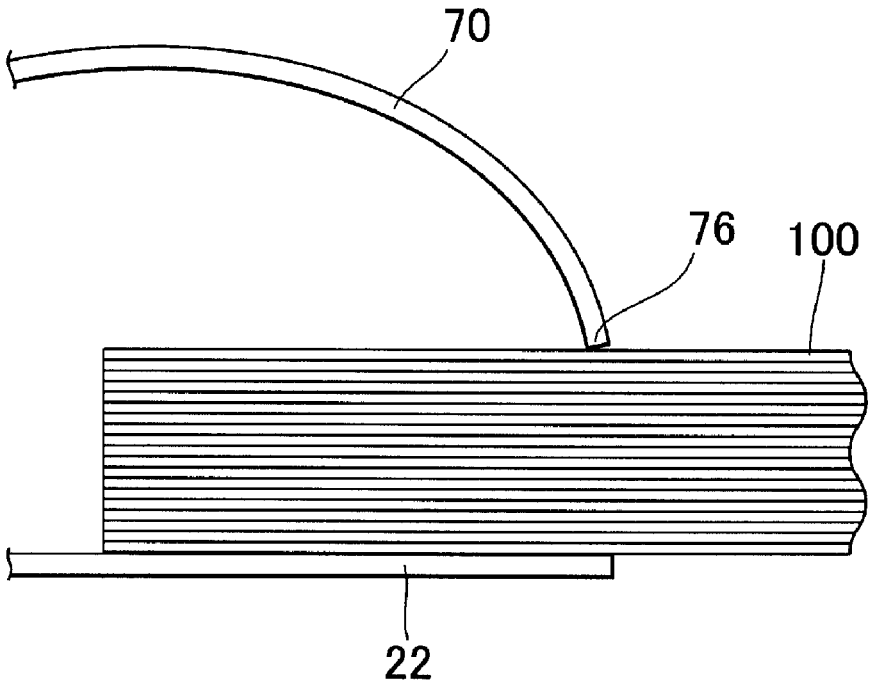
FIG. 16 is a diagram illustrating the state wherein a large amount of paper is bound with the binding device of FIG. 12.

The shape of the pressing portion 76 is not limited to the one that is formed by turning the end of the binding member 70, and as shown in FIG. 15, the distal end of the warped plate-like binding member 70 may function as the pressing portion 76. In this case, the binding member 70 should preferably have a semi-circular cross section so that the pressing portion 76 makes contact with the surface of the objects to be bound 100, such as paper, at more or less the same angle irrespective of the thickness of the objects 100, as shown in FIG. 16. In this way, the entire binding member 70 resists the force that is applied in the pulling-out direction of the bound objects 100, such as paper, whereby the objects 100 do not easily come off.

Figure 17:
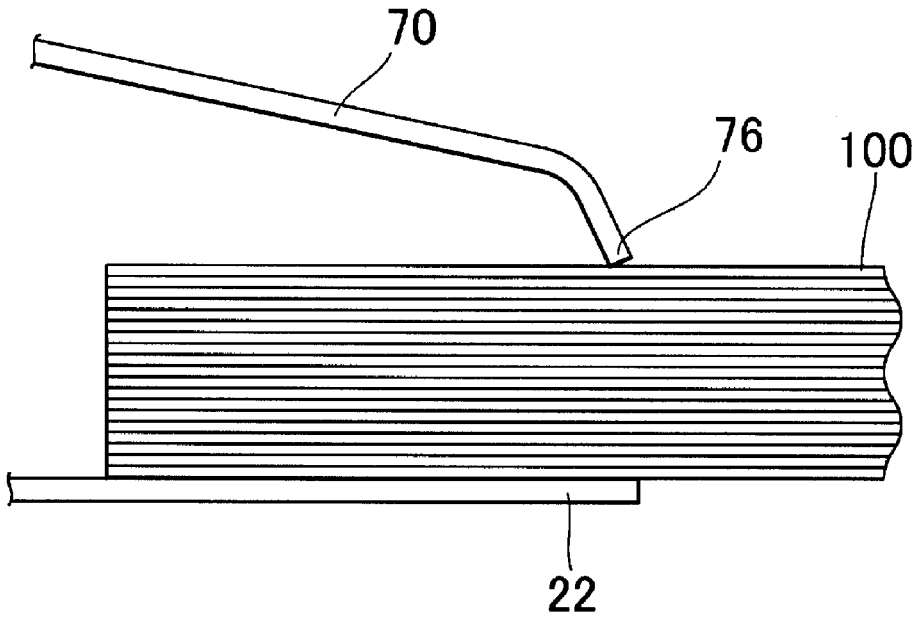
FIG. 17 is a diagram illustrating the state wherein a large amount of paper is bound with a binding device having a different pressing portion.

In contrast, if the binding member 70 were bent to have a substantially rectangular cross section, when the objects to be bound 100, such as paper, are thick, the pressing portion 76 would be inclined along the pulling-out direction of the objects 100 as shown in FIG. 17, and thus, would have a low resisting force against the force that acts in the pulling-out direction of the objects 100, and the objects 100 would easily come off. Therefore, when the distal end of the binding member 70 is not bent to function as the pressing portion 76, the binding member 70 should preferably have a substantially semi-circular or curved cross section.

Figure 18:
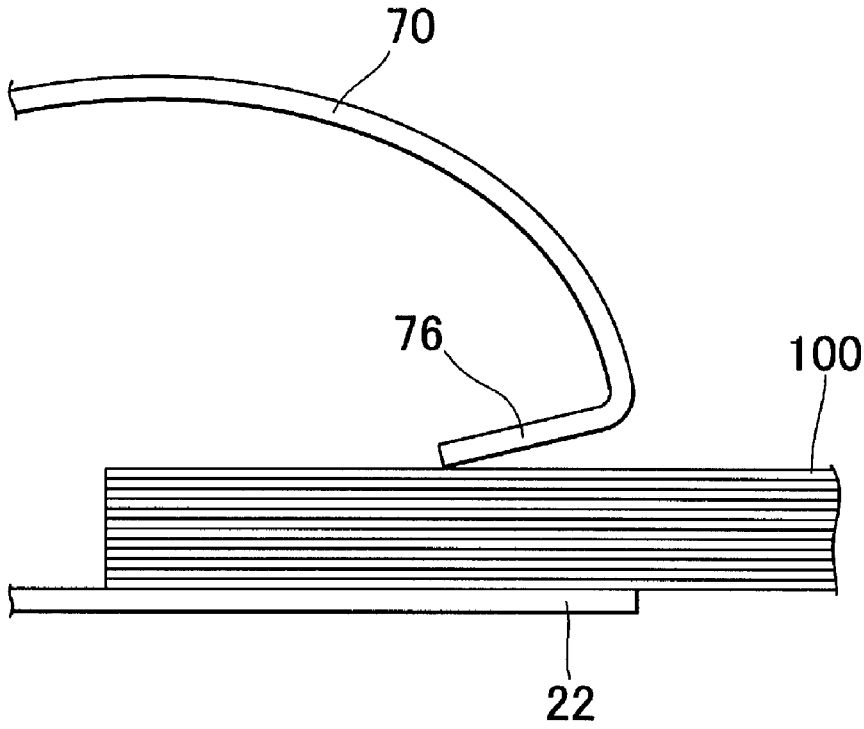
FIG. 18 is a diagram illustrating the state wherein sheets of paper are bound with a binding device having a different pressing portion.

If the pressing portion 76 is made by bending the binding member 70, it may be formed by bending the distal end of the binding member 70 only once toward the rotation center, as shown in FIG. 18. In this case, no turned portion 74 is provided, but when a force is applied that causes the bound objects 100, such as paper, to be pulled out, there will be a force that acts in an opposite direction from the inclined direction of the pressing portion 76, whereby the pressing portion 76 deforms so as to stand up. Therefore, the restoring force caused by the deformation of the pressing portion 76 creates a resisting force against the pulling-out of the bound objects 100, such as paper.

It should be noted that in the binding device 20 having any of the pressing portions 76 shown in FIG. 15, FIG. 17, or FIG. 18, the portion pressed with the pressing portion 76 may either be one straight line or a plurality of points or lines along a straight line, as shown in from FIG. 6 to FIG. 8.

Figure 19:
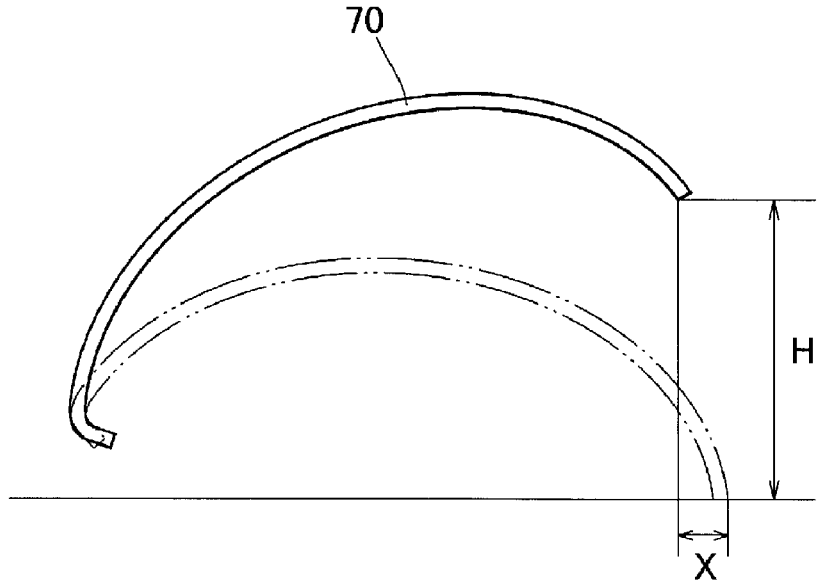
FIG. 19A and FIG. 19B are diagrams illustrating the relationship between the width of the binding member and a difference in the binding position when the binding device is open.
Figure 19:
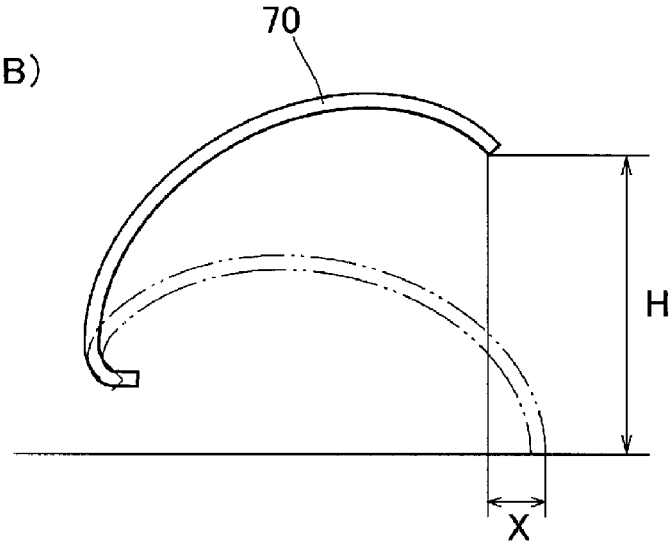

When, as shown in FIG. 19A and FIG. 19B, the height H of the pressing portion 76 from the board 22 is the same when the binding member 70 is open, the larger the width of the binding member 70 is, the smaller the difference X is between the open position and the closed position of the pressing portion 76 to the surface of the board 22. Therefore, when binding the objects 100, such as paper, there is less misalignment between the position of the pressing portion 76 when the binding member 70 is open and the binding position of the bound objects 100, such as paper, whereby the binding of the objects 100, such as paper is facilitated.

Figure 20:
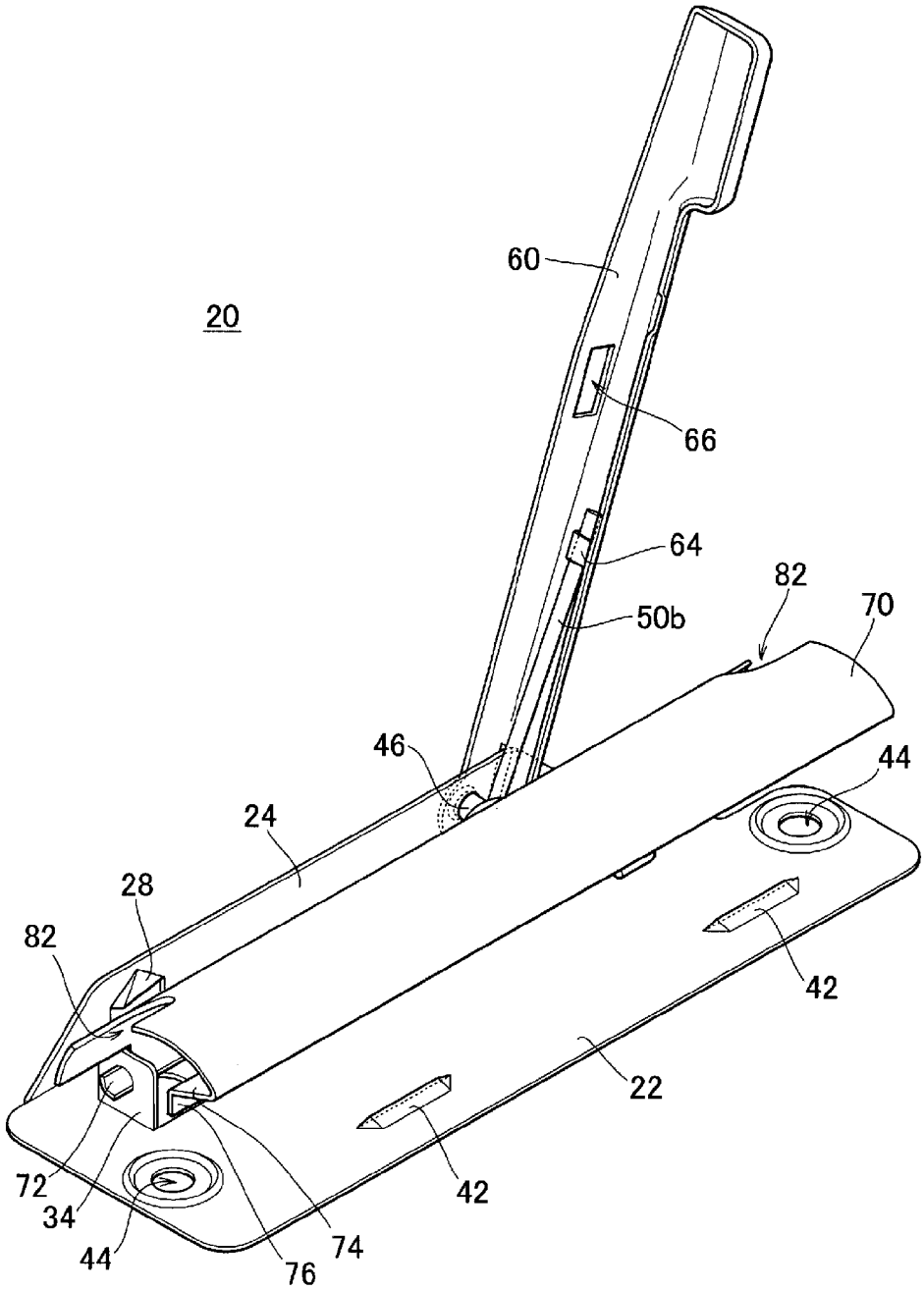
FIG. 20 is a perspective view illustrating yet another preferred embodiment of the binding device according to the present invention.

To make the width of the binding member 70 larger, as shown in FIG. 20, the vertical side wall of the operation lever 60 may be arranged on the outer side of the bearing plate 24. With the retainer projection 28 being configured to protrude outwardly from the bearing plate 24, the operation lever 60 is displaced to the outer side of the bearing plate 24 to open the binding member 70. Therefore, the operation lever 60 need not be displaced toward the binding member 70, and the binding member 70 can be brought closer to the bearing plate 24, i.e., the width of the binding member 70 can be increased.

In FIG. 20, the binding member 70 includes notches 82 at both lengthwise ends, and the through holes 44 are provided in the board 22 at positions corresponding to the notches 82. Accordingly, the binding device 20 can be attached to a file using metal fixture parts or other suitable fixture elements inserted into the through holes 44 through the notches 82.

Figure 21:
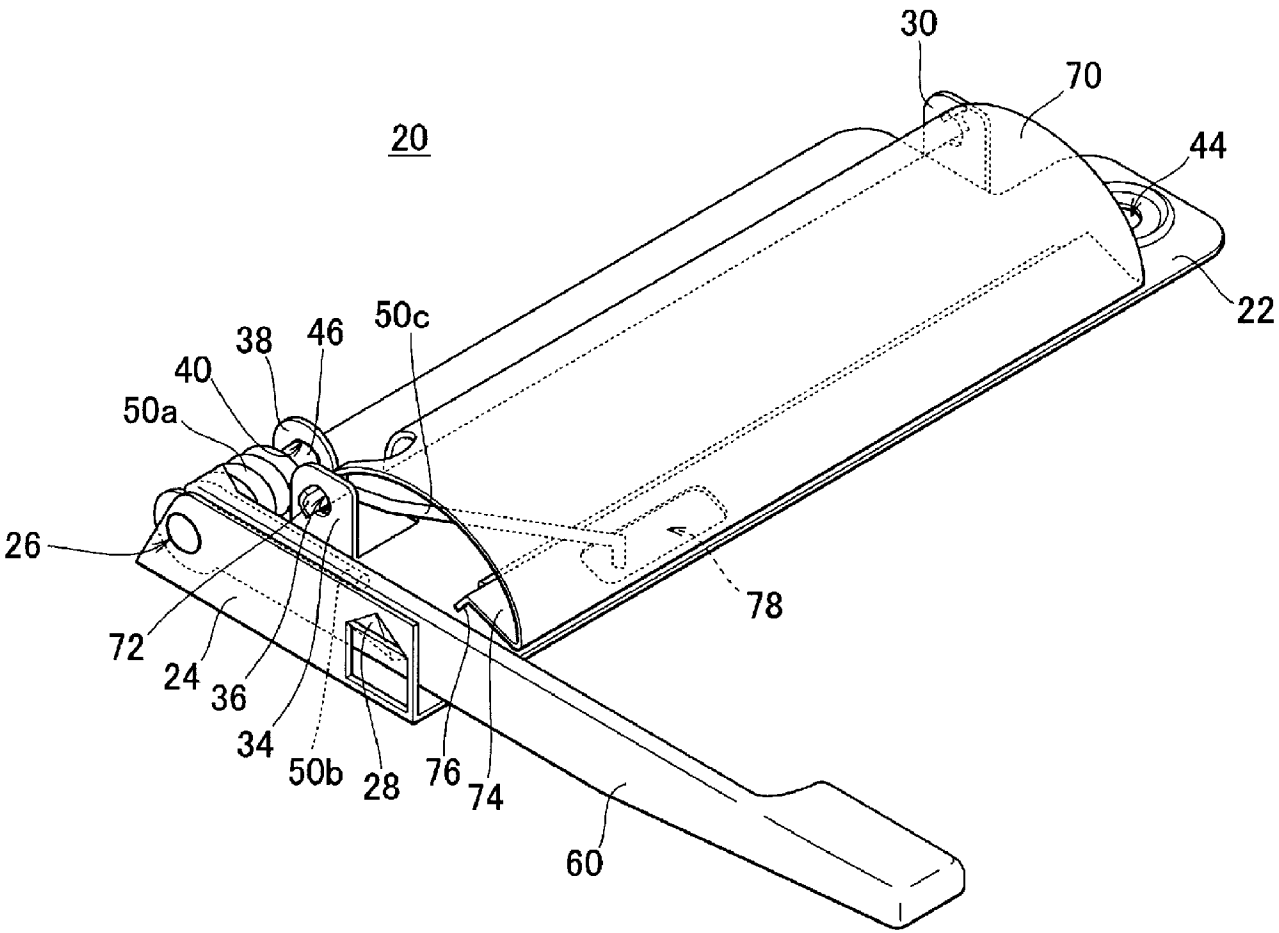
FIG. 21 is a perspective view illustrating another preferred embodiment of the binding device according to the present invention.

Furthermore, as shown in FIG. 21, it is possible to arrange the rotation direction of the operation lever 60 to be the same as that of the binding member 70. In this binding device 20, the bearing plate 24 is provided at one lengthwise end of the board 22. The shaft 46 is inserted into the through hole 26 in the bearing plate 24 to extend along the length of the board 22. The coil part 50*a* of the spring member 50 and the operation lever 60 are attached to this shaft 46. One end 50*b* of the spring member 50 extends along the width of the board 22 and secured to the operation lever 60. The other end 50*c* of the spring member 50 extends along the width of the board 22 and fits in the through hole 78 provided in the turned portion 74 of the binding member 70. This binding device 20 is used, for example, to bind one lengthwise end of the objects 100 to be bound, such as paper. In this case, the binding device 20 is arranged at one widthwise end of the objects 100 to be bound, such as paper, with the operation lever 60 being arranged on the outer side of the objects 100.

In other words, this binding device 20 includes the board 22 made of a thin metal plate. A bearing plate 24, which is upright relative to the board 22, is integrally provided along the straight left side edge at one lengthwise end of the board 22. The bearing plate 24 is continuous from the front end edge to the vicinity of the rear end edge of the width of the board 22. At one lengthwise end (rear end) of the bearing plate 24, a substantially circular through hole 26 is provided, and at the other lengthwise end (front end) of the bearing plate 24, a retainer projection 28 is provided to retain the operation lever 60. The retainer projection 28 is formed by, for example, providing a quadrangle aperture in the bearing plate 24 and pressing out an upper part of the aperture towards the board 22.

Near the through hole 26 of the bearing plate 24, at a suitable distance from the bearing plate 24, one lengthwise end of the board 22 is cut and turned up to form a turned-up part 34. The main surface of the turned-up part 34 is substantially parallel to the main surface of the bearing plate 24. This turned-up part 34 is preferably defined by a substantially circular through hole 36.

Furthermore, near the right end of the board 22 another turned-up part 30 that has a surface substantially parallel to the main surface of the turned-up part 34 is provided. The turned-up part 30 is provided by cutting and turning up part of the edge of the board 22. This turned-up part 30 includes a substantially circular through hole 32.

These turned-up parts 30 and 34 are arranged so that a line connecting their through holes 32 and 36 is substantially parallel to the main surface of the bearing plate 24 on the side of the board 22.

Between these turned-up parts 30 and 34, a turned-up part 38 is provided that has a surface that is substantially parallel to the surface of the bearing plate 24. This turned-up part 38, is provided by forming a substantially U-shape cut in the board 22 and turning up this part. This turned-up part 38 includes a substantially circular through hole 40 and is positioned such that its through hole 40 is opposite the through hole 26 of the bearing plate 24. That is, the turned-up part 38 is configured so that the line connecting the through holes 32 and 36 of the turned-up parts 30 and 34 is substantially parallel to the line connecting the through holes 26 and 40 of the bearing plate 24 and the turned-up part 38.

Through holes 44 for attaching the binding device 20 to a file or other suitable article are provided at both lengthwise ends of the board 22.

A shaft 46 is inserted in the through hole 26 of the bearing plate 24 and in the through hole 40 of the turned-up part 38, and a spring member 50 including a torsion coil spring and the operation lever 60 are attached to the shaft 46. The spring member 50 includes a coil part 50*a*, one end 50*b* of the coil part 50*a* extending substantially parallel to the surface of the bearing plate 24, and the other end 50*c* of the coil part 50*a* extending in the widthwise direction of the board 22 toward a direction away from the bearing plate 24.

The operation lever 60 is made of a metal plate or other suitable material and has an elongated shape with a substantially L-shaped or U-shaped cross section to increase its strength. A substantially circular through hole 62 is provided in the vertical side wall at one lengthwise end of the operation lever 60. The shaft 46 is attached to the bearing plate 24 and the turned-up part 38 such that it is inserted in the through hole 62 of the operation lever 60 and in the coil part 50*a* of the spring member 50. One end 50*b* of the spring member 50 is arranged to run along the inside of the operation lever 60 and secured with a bent portion 64 that is formed by inwardly bending part of the vertical side wall of the operation lever 60.

Furthermore, a substantially rectangular through hole 66 is provided in the side wall of the operation lever 60 at the position corresponding to the retainer projection 28 of the bearing plate 24. The retainer projection 28 is fitted in this through hole 66 to secure the operation lever 60 to the bearing plate 24. Furthermore, the other end in the lengthwise direction of the operation lever 60 includes a wide portion to allow easy operation with a finger.

Furthermore, a binding member 70 that is substantially rectangular in top view is attached on the board 22 so as to extend along the length of the board 22 so that the length of the binding member 70 is substantially parallel to the length of the bearing plate 24. The binding member 70 is made of, for example, a single metal plate. The binding member 70 has a length that is substantially equal to the distance between, for example, the turned-up parts 30 and 34, and includes a widthwise curved, upwardly bulging shape (semi-circular cross section). On the shaft 46 side of the width of the binding member 70, protruding pieces 72 are arranged so as to protrude from the lengthwise ends. These protruding pieces 72 are fitted in the through holes 32 and 36 of the turned-up parts 30 and 34. Therefore, the binding member 70 is rotatable around the line connecting the two protruding pieces 72.

To increase the strength of the protruding pieces 72 and to facilitate rotation of the protruding pieces 72 inside the through holes 32 and 36, the protruding pieces 72 are warped in the widthwise direction. Thus, the protruding pieces 72 protruding from the binding member 70 are fitted in the through holes 32 and 36 of the turned-up parts 30 and 34, whereby the number of components is reduced as compared to the design in which a rotation shaft is used to rotatably hold the binding member 70 rotatably.

The opposite side from the shaft 46 of the width of the binding member 70 is turned toward the above-described rotation center to define a turned portion 74. The turned portion 74 is continuous from the front end edge to the rear end edge of the binding member 70. Furthermore, the distal end of the turned portion 74 is turned toward the board 22 to define a pressing portion 76 arranged to press objects to be bound 100, such as paper. The pressing portion 76 is continuous from the front end edge to the rear end edge of the turned portion 74. The pressing portion 76, when the binding member 70 is closed on the board 22, is arranged to incline toward the rotation center of the binding member 70 from the turned portion 74 to the board 22. Therefore, the turned portion 74 and the pressing portion 76 are continuous in a substantially L-shaped manner. The pressing portion 76 presses the objects to be bound 100, such as paper, along one straight line.

When the binding member 70 is closed on the board 22, the turned portion 74 is inclined upward from one end of the binding member 70 to the inside of the binding member 70.

While the end 50*c* of the spring member 50 that is secured to the binding member 70 is provided at a position near the bearing plate 24 in the previous preferred embodiment, the end 50*c* of the spring member 50 may be secured to the binding member 70 near the center of the length of the turned portion 74 such that the force will be applied entirely along the length of the pressing portion 76.

Thus, in one preferred embodiment of the binding device 20 of the present invention, the binding member 70 operates at the binding position of the objects 100 to be bound, such as paper, whereby the paper can be held precisely at a desired position.

Furthermore, as the spring member applies a force to the vicinity of the pressing portion 76 that is at the distal end of the binding member 70, the force is efficiently applied to the pressing portion 76 when the operation lever 60 is operated, and the bound objects 100, such as paper, will not easily come off.

The present invention is not limited to the foregoing preferred embodiments and it can be modified in various different ways within the concept of the invention.

Next, examples of modification of various preferred embodiments of the present invention shown in from FIG. 9 to FIG. 12 will be described.

Figure 22:
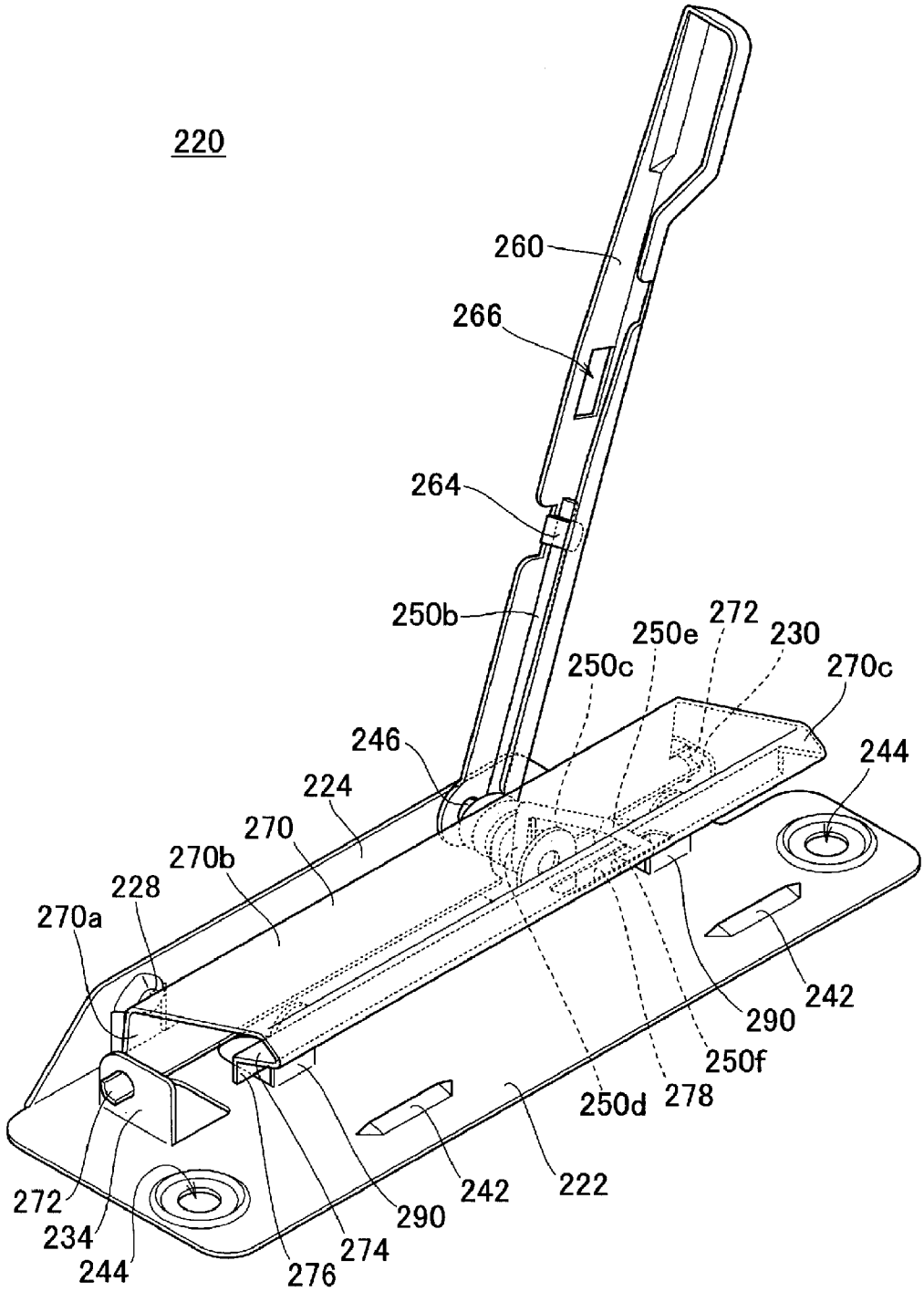
FIG. 22 is a perspective view illustrating another preferred embodiment of the binding device according to the present invention.
Figure 23:
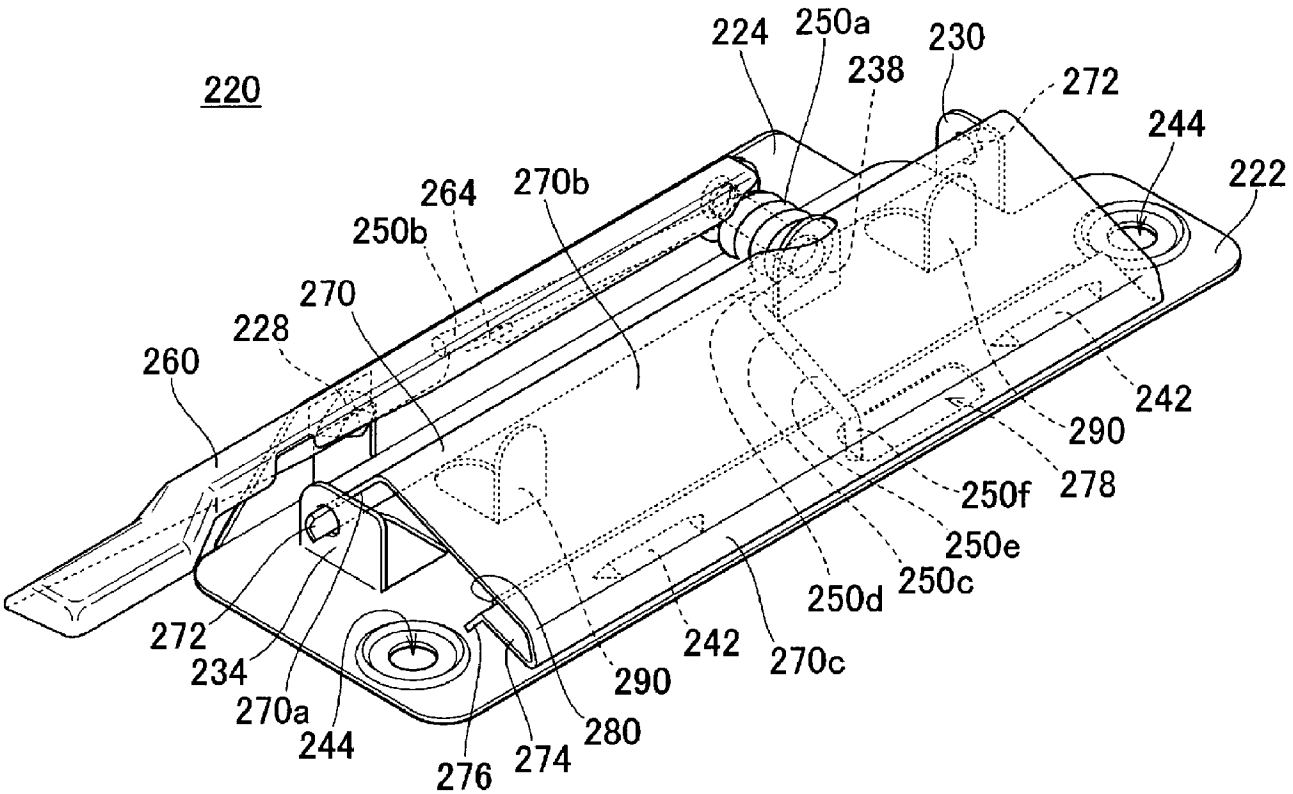
FIG. 23 is a perspective view of this binding device in a closed state.

FIG. 22 is a perspective view illustrating one example of the binding device according to a preferred embodiment of the present invention, and FIG. 23 is a perspective view of this binding device in a closed state.

Figure 24:
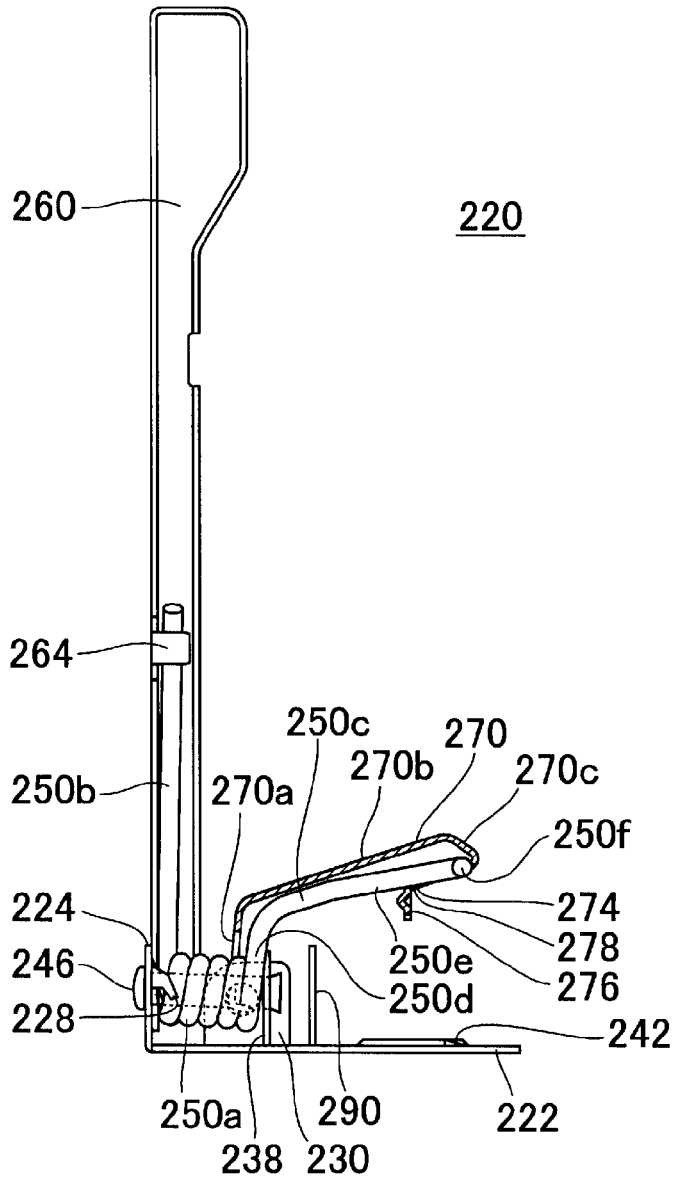
FIG. 24 is a side diagram of the binding device in an open state.
Figure 25:
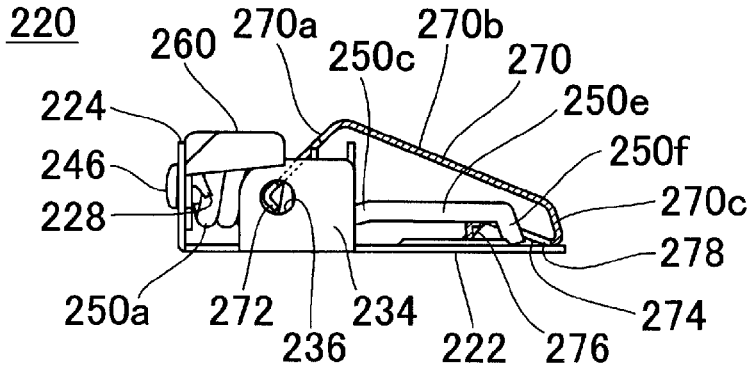
FIG. 25 is a side diagram of the binding device in a closed state.

FIG. 24 is a side diagram of the binding device in an open state, and FIG. 25 is a side diagram of the binding device in a closed state.

Figure 26:
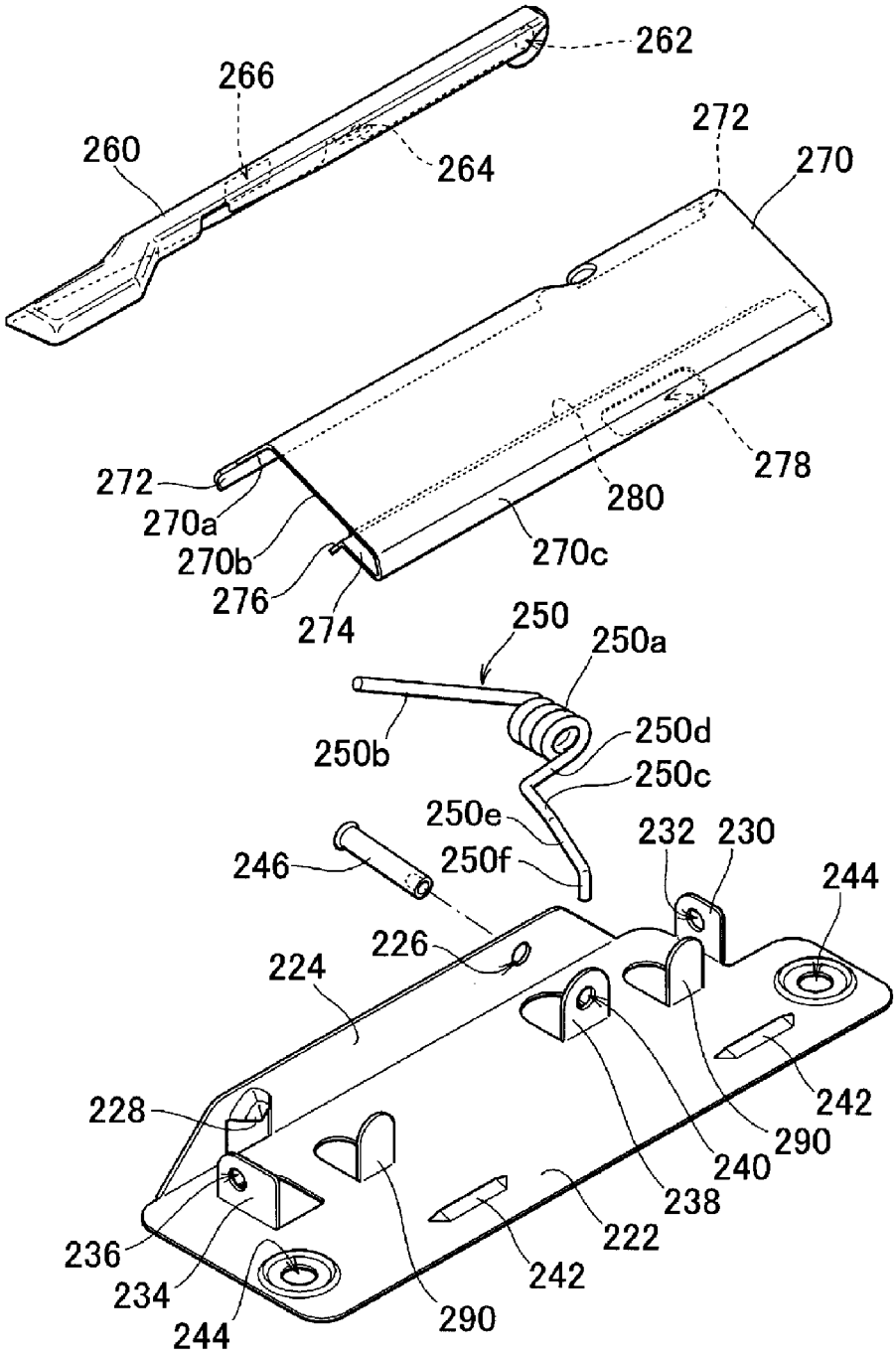
FIG. 26 is an exploded perspective view of the binding device of FIG. 22.

The binding device 220 includes a board 222 made of a thin metal plate. Along the straight lengthwise edge on one side of the width of the board 222, a bearing plate 224 that is upright relative to the board 222 is integrally provided, as shown in FIG. 26. The bearing plate 224 is continuous from the front end edge to the vicinity of the rear end edge along the length of the board 222. At one lengthwise end (rear end) of the bearing plate 224, a substantially circular through hole 226 is provided, and at the other lengthwise end (front end) of the bearing plate 224, a retainer projection 228 is provided to retain an operation lever that will be described later.

The retainer projection 228 is formed by, for example, providing a quadrangle aperture in the bearing plate 224 and pressing out an upper part of the aperture towards the board 222.

Near the rear end of the bearing plate 224 at which the through hole 226 is provided, at a suitable distance from the bearing plate 224, one corner at one lengthwise end of the board 222 is cut and turned up to form a turned-up part 230. The main surface of the turned-up part 230 is substantially perpendicular to the main surface of the bearing plate 224.

This turned-up part 230 includes a substantially circular through hole 232. Furthermore, another turned-up part 234 that has a surface substantially parallel to the main surface of the turned-up part 230 is provided near the front end at which the retainer projection 228 is provided.

The turned-up part 234 is provided by forming a U-shape cut in the board 222 and turning up this part. This turned-up part 234 includes a substantially circular through hole 236. These turned-up parts 230 and 234 are opposite each other such that a line connecting their through holes 232 and 236 is substantially parallel to the main surface of the bearing plate 224 on the side of the board 222.

Between these turned-up parts 230 and 234 and on the side away from the bearing plate 224 relative to the line connecting the through holes 232 and 236 of the turned-up parts 230 and 234, a turned-up part 238 that has a surface substantially parallel to the surface of the bearing plate 224 is provided. This turned-up part 238, is provided by forming a U-shape cut in the board 222 and turning up this part. This turned-up part 238 includes a substantially circular through hole 240 and is positioned such that its through hole 240 is opposite the through hole 226 of the bearing plate 224. That is, the turned-up part 238 is arranged such that the line connecting the through holes 232 and 236 of the turned-up parts 230 and 234 is substantially perpendicular to the line connecting the through holes 226 and 240 of the bearing plate 224 and the turned-up part 238.

At the other widthwise end of the board 222, two projections 242 are provided. These projections 242 are arranged side by side and spaced from each other in the lengthwise direction of the board 222. Furthermore, a pair of through holes 244 is provided at both lengthwise ends of the board 222, one each at the front end and at the rear end, for attaching the binding device 220 to a file or other suitable article.

A shaft 246 is inserted in the through hole 226 of the bearing plate 224 and in the through hole 240 of the turned-up part 238, and a spring member 250 including a torsion coil spring and the operation lever 260 are attached to the shaft 246. The spring member 250 includes a coil part 250*a*, one end 250*b* of the coil part 250*a* extending substantially parallel to the surface of the bearing plate 224, and the other end 250*c* of the coil part 250*a* extending in the widthwise direction of the board 222 toward a direction away from the bearing plate 224.

One end 250*b* of the spring member 250 extends linearly from the rear upper end on the bearing plate 224 side of the coil part 250*a* to the front, and is arranged such that, when no force is applied to its distal end, the distal end extends diagonally upwards toward the front. The other end 250*c* is substantially L-shaped, extending from the front lower end on the side of the turned-up part 238 of the coil part 250*a* toward the opposite side from the bearing plate 224, and when no force is applied, its upright portion 250*d* extends upwards and a bridge portion 250*e* extends diagonally upwards from the upper end of the upright portion 250*d*, and a projecting engaging portion 250*f* is turned horizontally from the free end of the bridge portion 250*e*.

The operation lever 260 is made of a metal plate or other suitable material and has an elongated shape with a substantially L-shaped or U-shaped cross section to increase its strength. A substantially circular through hole 262 is provided in the vertical side wall at one lengthwise end of the operation lever 260.

The shaft 246 is attached to the bearing plate 224 and the turned-up part 238 such that it is inserted in the through hole 262 of the operation lever 260 and in the coil part 250*a* of the spring member 250. One end 250*b* of the spring member 250 is arranged to run along the inside of the operation lever 260 and secured with a bent portion 264 that is formed by inwardly bending part of the vertical side wall of the operation lever 260.

Further, a substantially rectangular through hole 266 is provided in the vertical wall of the operation lever 260 at the position corresponding to the retainer projection 228 of the bearing plate 224. The retainer projection 228 is fitted in this through hole 266 to secure the operation lever 260 to the bearing plate 224. Further, the other lengthwise end of the operation lever 260 includes a wide portion to allow easy operation with a finger.

Furthermore, a binding member 270 that is substantially rectangular in top view is attached on the board 222 so as to extend along the length of the board 222 and substantially parallel to the bearing plate 224. The binding member 270 is made of, for example, a single metal plate. The binding member 270 has a length that is substantially equal to the distance between, for example, the turned-up parts 230 and 234, and has a widthwise bent, upwardly bulging shape (substantially L-shape cross section). On the bearing plate 224 side of the width of the binding member 270, protruding pieces 272 or pivotal axes are provided so as to protrude from the lengthwise ends. These protruding pieces 272 are fitted in the through holes 232 and 236 of the turned-up parts 230 and 234, which function as bearings. Therefore, the binding member 270 is rotatable around the line connecting the two protruding pieces 272.

To increase the strength of the protruding pieces 272 and to facilitate rotation of the protruding pieces 272 inside the through holes 232 and 236, the protruding pieces 272 are warped in the widthwise direction. Thus, the protruding pieces 272 protruding from the binding member 270 are fitted in the through holes 232 and 236 of the turned-up parts 230 and 234, whereby the number of components is reduced as compared to the design in which a separate part, such as a rotation shaft, is used to hold the binding member 270 rotatably.

The opposite side from the bearing plate 224 of the width of the binding member 270 is turned at about 20° relative to the horizontal plane toward the above-described rotation center (protruding pieces 272 side) to form a turned portion 274. The turned portion 274 is continuous from the front end edge to the rear end edge of the binding member 270. Furthermore, the distal end of the turned portion 274 is turned toward the board 222 to define a pressing portion 276 which is for pressing objects to be bound 100, such as paper. The pressing portion 276 is continuous from the front end edge to the rear end edge of the turned portion 274. The pressing portion 276 is arranged to incline toward the rotation center of the binding member 270 from the turned portion 274 to the board 222 when the binding member 270 is closed on the board 222. Therefore, the turned portion 274 and the pressing portion 276 are continuous in a substantially L-shaped manner.

This pressing portion 276 presses the bound objects 100, such as paper, along one straight line. When the binding member 270 is closed on the board 222, the turned portion 274 is inclined upward from one end of the binding member 270 to the inside of the binding member 270.

Figure 27:
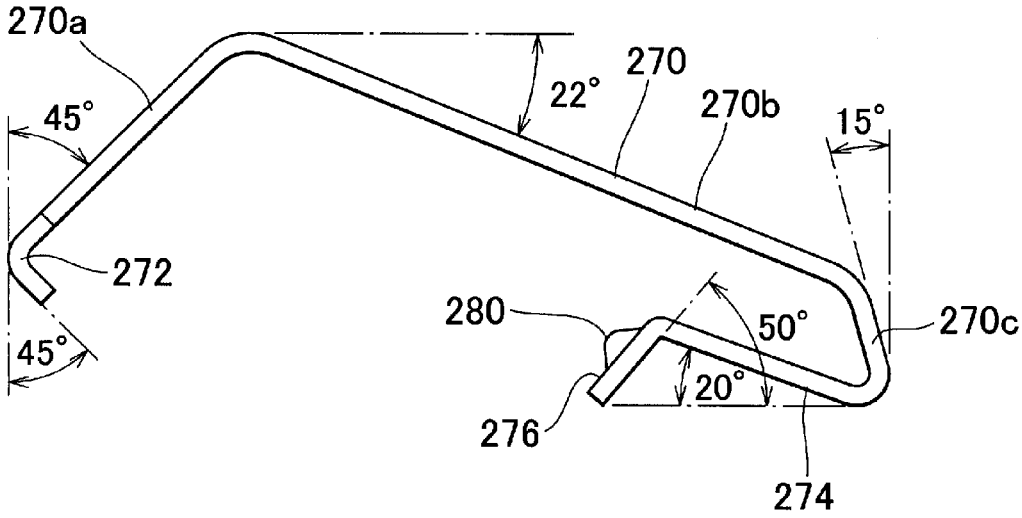
FIG. 27 is a front view of the binding device.

The binding member 270 includes, as shown in FIG. 27, a standing portion 270*a* extending diagonally upwards from the side of the protruding pieces 272 towards the opposite side from the bearing plate 224, a bridge portion 270*b* extending diagonally (at about 22° relative to the horizontal plane) downwards from the top end of the standing portion 270*a*, a turned portion 274 provided at the free end of the bridge portion 270*b*, and a pressing portion 276, all of these standing portion 270*a*, bridge portion 270*b*, turned portion 274, and pressing portion 276 being made in one, single piece. At the free end of the bridge portion 270*b*, a bent portion 270*c* is provided by bending the free end diagonally (at about 15° relative to the vertical plane) downwards, from the front end edge to the rear end edge of the binding member 270.

The turned portion 274 is provided continuously to the free end of the bent portion 270*c*, the turned portion 274 being spaced from and substantially parallel to the bridge portion 270*b*, so that it is slightly bent towards the bridge portion 270*b* when the pressing portion 276 presses down the bound objects 100, such as paper.

The standing portion 270*a* has an inclined surface (at about 45° relative to the vertical plane) such that the gap between itself and the bearing plate 224 becomes wider upwards to secure space for releasing the operation lever 260 from the retainer projection 228.

The other end 250*c* of the spring member 250 has a shape similar to the inner surface of the binding member 270, and is set on the inner side of the binding member 270 such that the upright portion 250*d* of the spring member 250 is arranged near the inner surface of the standing portion 270*a* of the binding member 270, and the bridge portion 250*e* of the spring member 250 is arranged near the inner surface of the bridge portion 270*b* of the binding member 270.

The turned portion 274 includes a substantially rectangular through hole 278, and the other end 250*c* of the spring member 250 is fitted therein from the side of the bridge portion 270*b*, the distal end (engaging portion 250*f*) of the other end 250*c* of the spring member 250 being bent so that it does not disengage with the through hole 278.

In this preferred embodiment, the through hole 278 is arranged at a position closer to the coil part 250*a* coiled around the shaft 246, between the protruding pieces 272 at the front and rear ends of the binding member 270. Further, the pressing portion 276 includes a linear rib 280 to prevent deformation caused by the force applied to press down the bound objects 100, such as paper.

Figure 28:
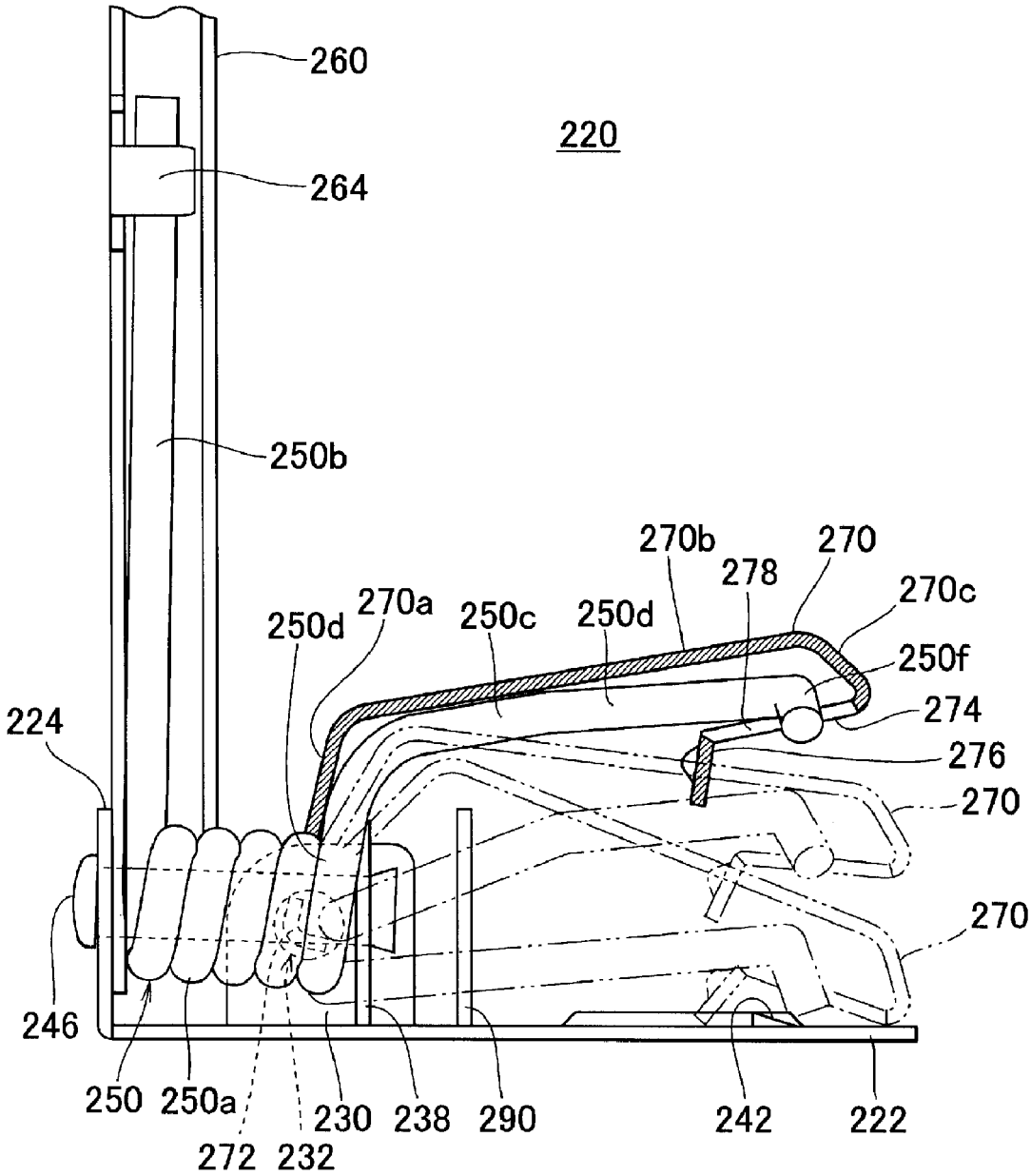
FIG. 28 is a diagram illustrating the operating state of the binding member and the spring member of the binding device of FIG. 22.

The distal end (engaging portion 250*f*) of the spring member 250 remains substantially in the same position in the widthwise direction of the board 222 whether the binding member 270 is closed or opened as shown in FIG. 28. When the operation lever 260 is locked in the retainer projection 228, with the binding member 270 pressing down the bound objects 100, such as paper, the other end 250*c* of the spring member 250, which is initially bent, is stretched, and the distal end (engaging portion 250*f*) is twisted so that the engaging portion 250*f* is deformed downwards from its initial horizontal position. The through hole 278 extends along the length and the width of the turned portion 274 so as to allow this deformation of the spring member 250.

The board 222 includes a paper jogging part 290 arranged to jog the side edges of the objects 100 to be bound, such as paper, the jogging part being provided on a side that is outward of the protruding pieces 272 from the turned-up part 234 and having a surface that is substantially parallel to the surface of the bearing plate 224. The paper jogging part 290 is provided by forming a U-shape cut in the board 222 and turning up this part. Note, the turned-up part 234 is configured such that its side edge opposite from the bearing plate 224 is aligned with the (imaginary) plane that coincides with the surface of the paper jogging part 290 on the opposite side from the bearing plate 224. Therefore, the side edge of the turned-up part 234 functions as a guide, on which the side edges of the objects 100 to be bound, such as paper, are abutted when binding them.

This binding device 220 is attached to a file or other suitable article using, for example, metal fixture parts inserted in the through holes 244 in the board 222.

The binding member 270 is opened and closed by operating the operation lever 260. Referring now to FIG. 22, when the operation lever 260 is turned up, the other end 250*c* of the spring member 250 lifts up the binding member 270, creating a gap between the board 222 and the pressing portion 276 of the binding member 270. Objects to be bound 100, such as paper, are inserted in this gap, and the operation lever 260 is turned down to close the binding member 270 so that the bound objects 100, such as paper, are pressed down onto the board 222 with the pressing portion 276.

That is, turning down the operation lever 260 tightens up the coil 250*a* of the spring member 250, whereby the other end 250*c* of the spring member 250 biases the pressing portion 276 toward the board 222.

Figure 29:
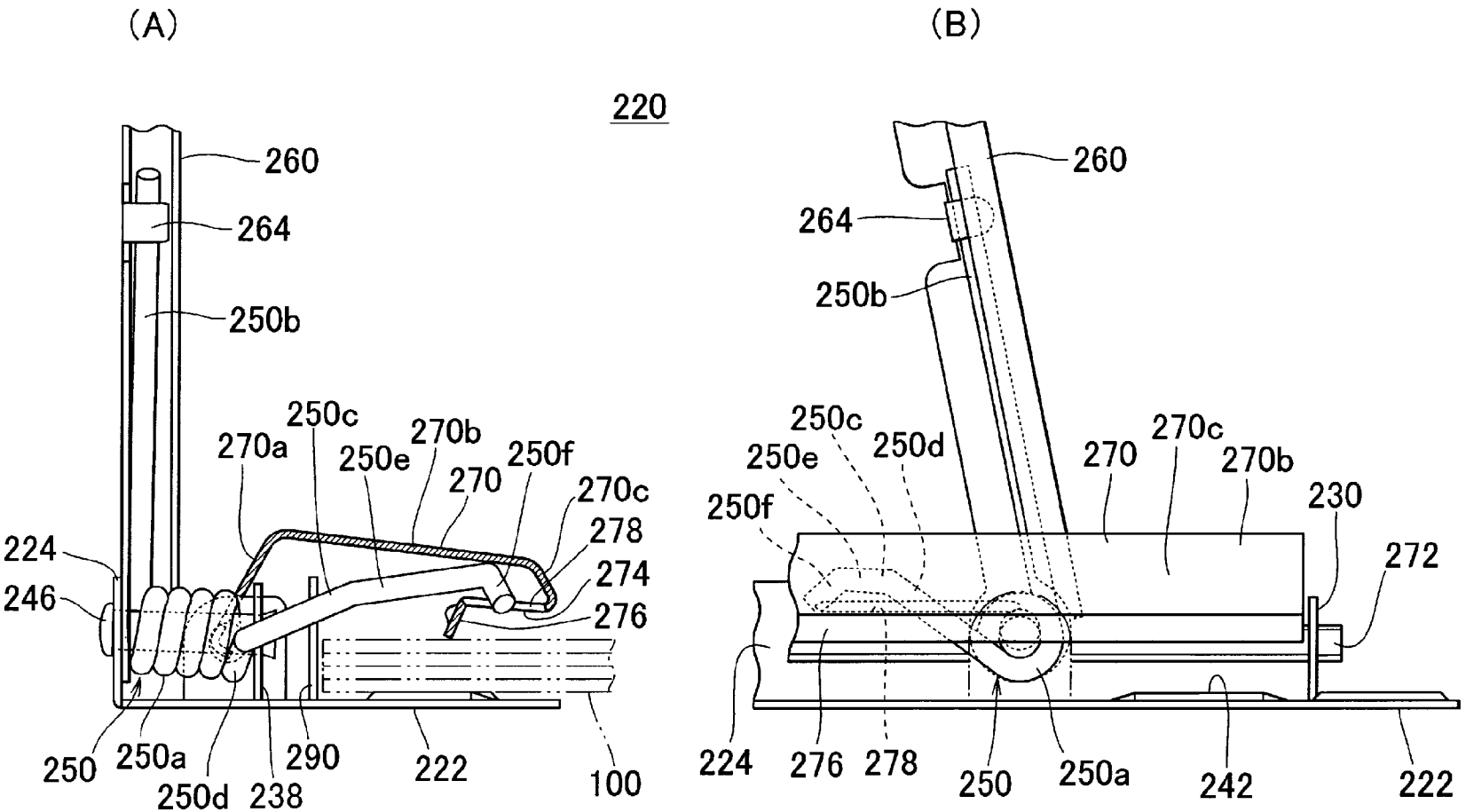
FIG. 29A is a front cross-sectional diagram and FIG. 29B is a partial side diagram illustrating the operating state of the binding member and the spring member of the binding device of FIG. 22.
Figure 30:
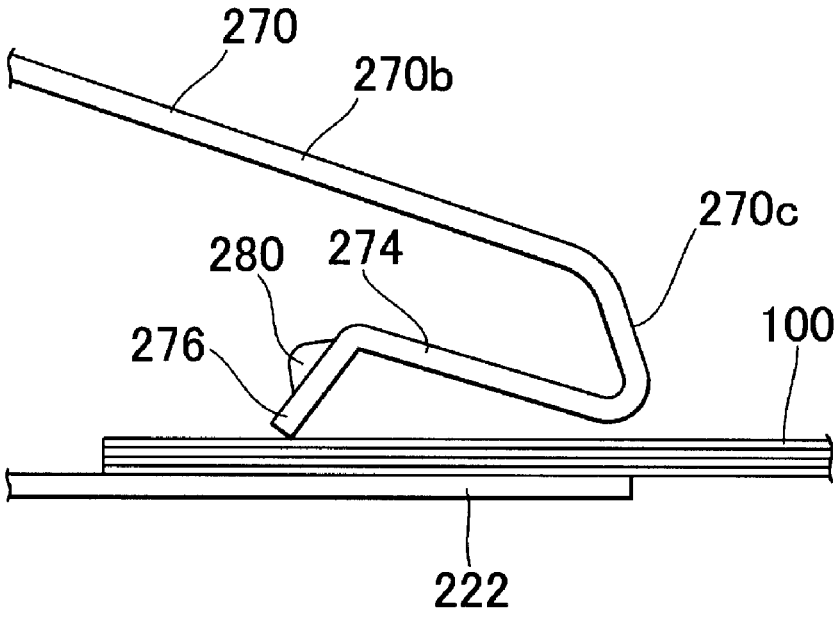
FIG. 30 is a diagram illustrating the state of the pressing portion when a small amount of paper is bound with the binding device of FIG. 22.

Here, as shown in FIG. 29 and FIG. 30, the pressing portion 276 is pressed diagonally against the bound objects 100, such as paper. When a force is applied that causes the bound objects 100, such as paper, to be pulled out, there will be a force applied opposite to the inclined direction of the pressing portion 276 and a force that causes the bent portion of the turned portion 274 and the pressing portion 276 to bend further.

The restoring force caused by the deformation of the turned portion 274 and the pressing portion 276 creates a resisting force against the pulling-out of the bound objects 100, such as paper, from the pressing portion 276, whereby the bound objects 100, such as paper, does not readily come off of the binding device 220.

Figure 31:
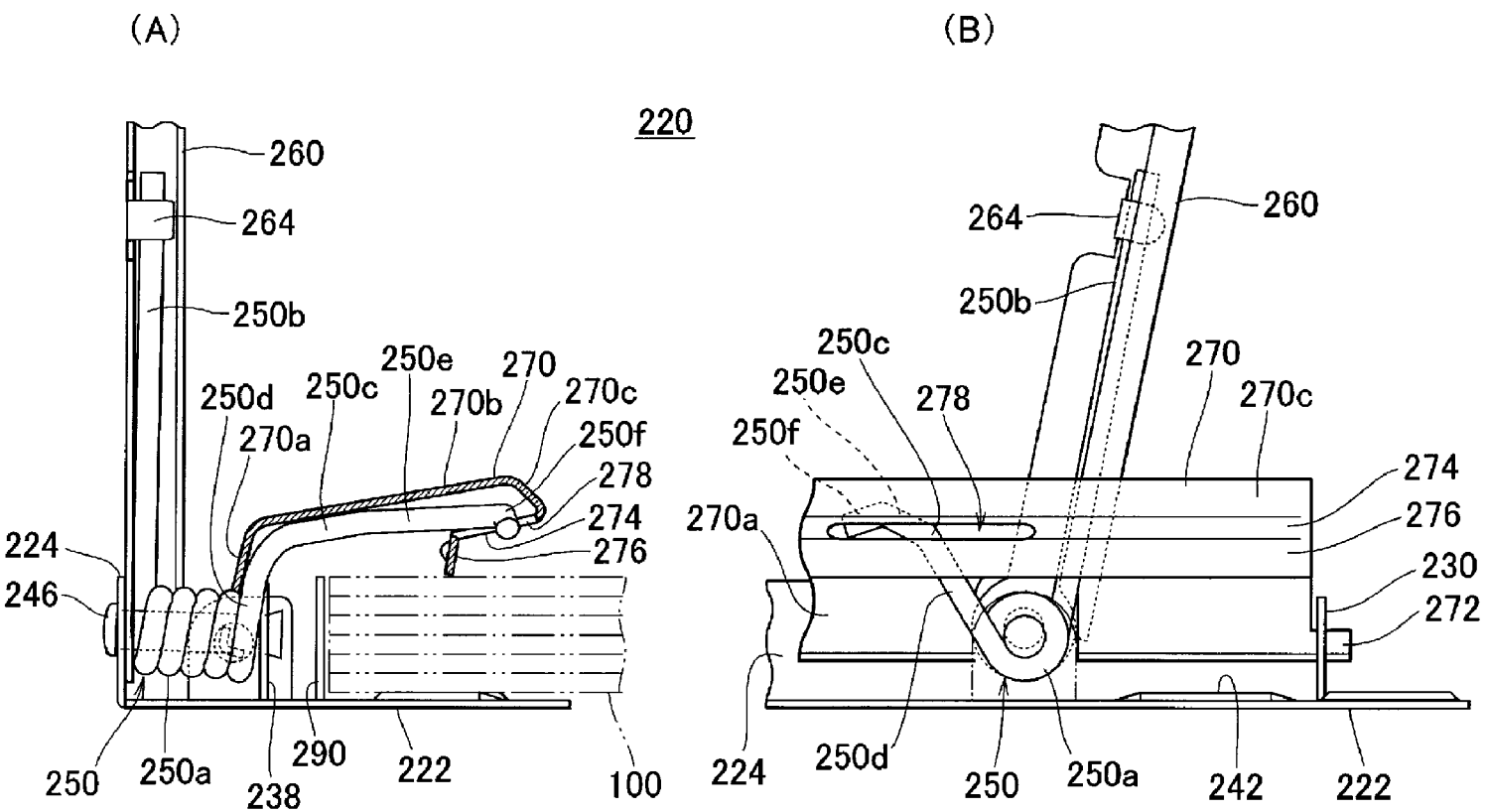
FIG. 31A is a front cross-sectional diagram and FIG. 31B is a partial side diagram illustrating the operating state of the binding member and the spring member of the binding device of FIG. 22.
Figure 32:
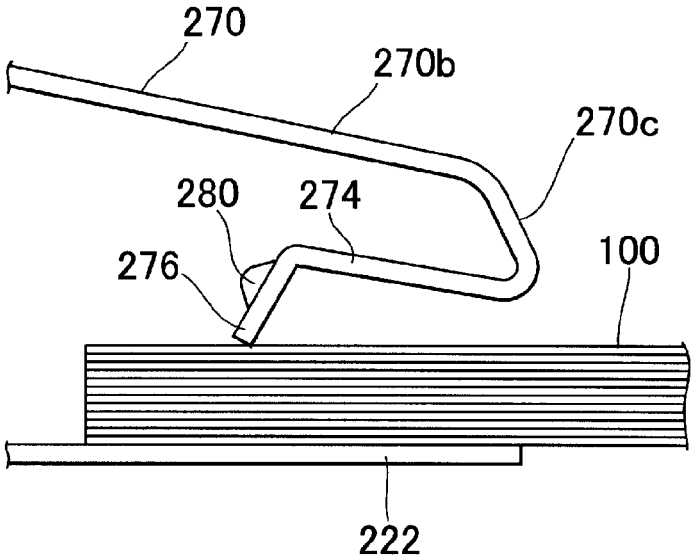
FIG. 32 is a diagram illustrating the state of the pressing portion when a large amount of paper is bound with the binding device of FIG. 22.
Figure 33:
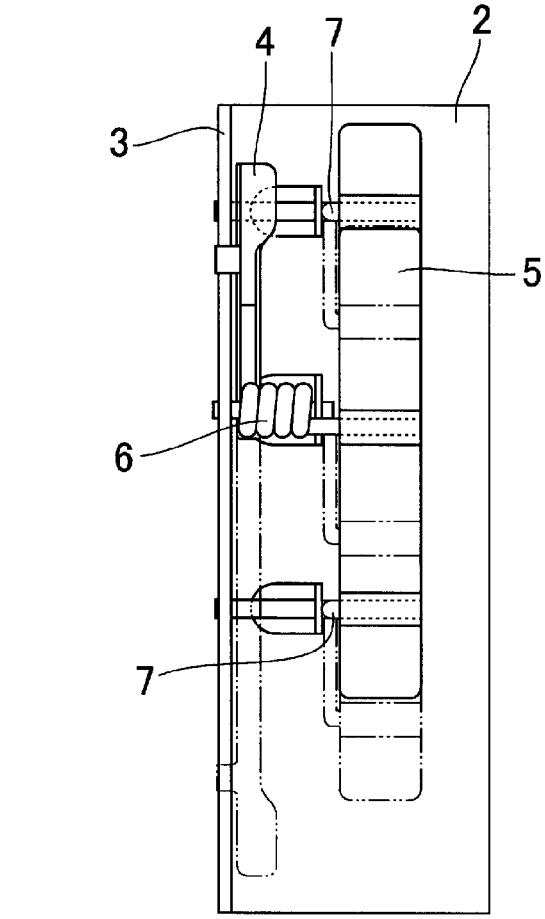
Fig. 33 PRIOR ART
FIG. 33 is a diagram illustrating one example of a conventional binding device.
Figure 34:
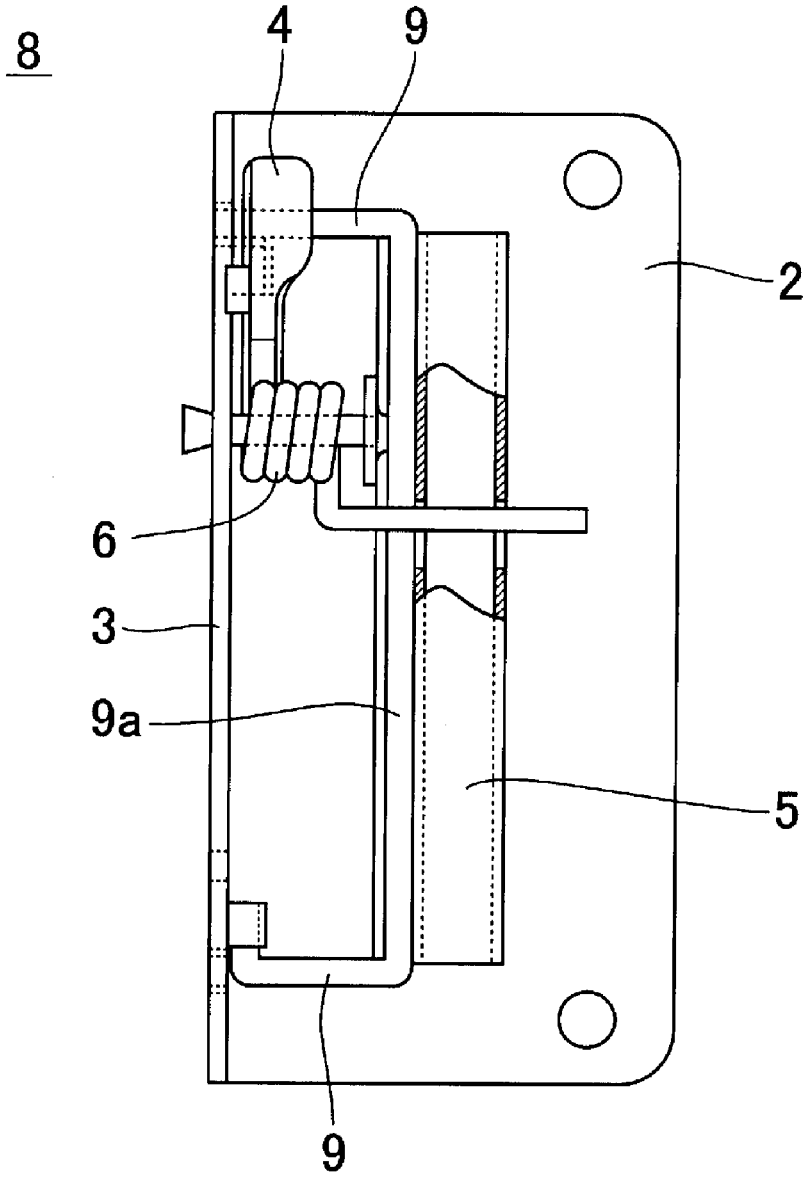
Fig. 34 PRIOR ART
FIG. 34 is a diagram illustrating another example of a conventional binding device.
Figure 35:
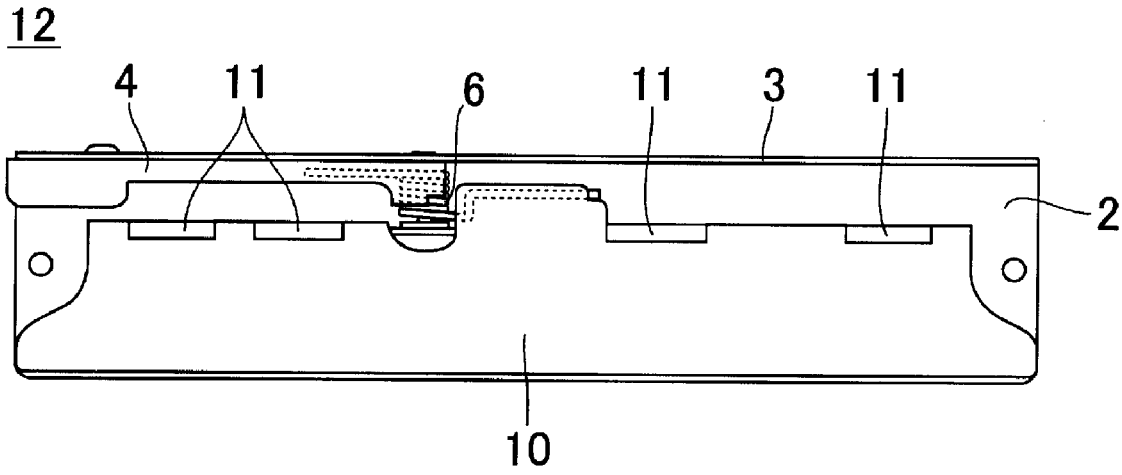
Fig. 35 PRIOR ART
FIG. 35 is a diagram illustrating yet another example of a conventional binding device.

Moreover, because the pressing portion 276 is inclined toward the rotation center of the binding member 270 from the turned portion 274 to the board 222, as shown in FIG. 31 and FIG. 32, when the bound objects 100, such as paper, are thick, the pressing portion 276, while it is more upright than when the objects 100 are thin, is unlikely to be perpendicular to the surface of the bound objects 100, such as paper, so that the resisting force against the coming-off of the bound objects 100, such as paper, is provided.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

The invention claimed is:

1. A binding device comprising:

a plate-shaped board;

an operation lever rotatably supported on the board;

at least a one-piece binding member including a rotation axis extending in a lengthwise direction of the binding member and a pressing portion arranged at a distal end of the binding member opposite to the rotation axis and arranged to press down and hold objects to be bound on the board; and a spring member including a winding portion fixed to a base plate, one end of the winding portion being coupled to the operation lever and the other end of the winding portion being coupled to the distal end of the binding member so as to apply a pressure to the distal end of the binding member by operating the operation lever; wherein the binding member is rotatable around the rotation axis to define a center of rotation when the operation lever is operated, and the binding member includes a turned portion extending from a portion of the binding member that is disposed farthest from the rotation axis towards the rotation axis, the pressing portion being defined by a portion of the turned portion that is bent to extend towards the rotation axis, a distal end of the pressing portion being arranged to press down and hold objects to be bound, and the other end of the winding portion of the spring member is provided in an internal face of the binding member and is coupled to the turned portion or the pressing portion such that pressure is applied to the turned portion by the spring member while the turned portion is bent away from the objects to be bound when the objects to be bound are pressed.

2. The binding device according to claim 1, wherein the binding member is made of a single plate material, and a distal end of the plate material defines the pressing portion such that the objects to be bound are pressed down along a straight line or at a plurality of positions along a straight line.

3. The binding device according to claim 2, wherein the pressing portion is defined by the distal end of the binding member made of the plate material that is bent towards the rotation center of the binding member.

4. The binding device according to claim 2, wherein the pressing portion is defined by a portion of the distal end of the binding member made of the plate material bent towards the rotation center of the binding member and another portion of the distal end bent toward the board side.

5. The binding device according to claim 2, wherein the rotation center of the binding member is defined by protruding pieces that project from both ends of the binding member and that are inserted into through holes provided in turned-up parts provided in the board.

6. The binding device according to claim 1, wherein a rotation axis of the operation lever and the rotation axis of the binding member are substantially perpendicular to each other.

7. The binding device according to claim 1, wherein a rotation axis of the operation lever and rotation axis of the binding member are substantially parallel to each other.

* * * * *